US009114917B1

(12) United States Patent
Salem

(10) Patent No.: US 9,114,917 B1
(45) Date of Patent: Aug. 25, 2015

(54) DRINKING VESSEL LID SYSTEMS

(76) Inventor: Jerry Hani Salem, Phoenix, AZ (US)

( * ) Notice: Subject to any disclaimer, the term of this patent is extended or adjusted under 35 U.S.C. 154(b) by 579 days.

(21) Appl. No.: 13/370,191

(22) Filed: Feb. 9, 2012

Related U.S. Application Data

(60) Provisional application No. 61/441,212, filed on Feb. 9, 2011, provisional application No. 61/450,043, filed on Mar. 7, 2011.

(51) Int. Cl.

| | |
|---|---|
| ***B65D 47/04*** | (2006.01) |
| ***A47G 19/22*** | (2006.01) |
| ***B60P 3/00*** | (2006.01) |
| ***B62D 33/00*** | (2006.01) |
| ***B65D 88/12*** | (2006.01) |

(52) U.S. Cl.
CPC ..... *B65D 47/043* (2013.01); *A47G 19/22* (2013.01); *A47G 19/2272* (2013.01); *B65D 2543/00055* (2013.01)

(58) Field of Classification Search
CPC ..... A47G 19/2255; A47G 19/2272; B65D 2543/00055; B65D 47/043
USPC ..... 220/521, 713, 719, 212; 222/454, 455, 222/564
See application file for complete search history.

(56) References Cited

U.S. PATENT DOCUMENTS

| | | | | |
|---|---|---|---|---|
| 3,152,735 | A * | 10/1964 | Caldwell | 222/455 |
| 5,538,157 | A | 7/1996 | Proshan | |
| 5,964,379 | A | 10/1999 | DeMars | |
| 6,010,029 | A | 1/2000 | Wang | |
| 6,176,390 | B1 | 1/2001 | Kemp | |
| 6,318,584 | B1 * | 11/2001 | Milan | 220/713 |
| 6,488,173 | B2 * | 12/2002 | Milan | 220/713 |
| 6,571,973 | B1 * | 6/2003 | Tripsianes | 222/256 |
| 7,185,781 | B2 | 3/2007 | Pitts | |
| 7,281,650 | B1 | 10/2007 | Milan | |
| 7,448,510 | B2 | 11/2008 | Pavlopoulos | |
| 7,789,260 | B2 | 9/2010 | Hollis et al. | |
| 8,469,227 | B2 * | 6/2013 | Tripsiznes | 220/719 |
| 2002/0003145 | A1 | 1/2002 | Milan | |
| 2006/0037962 | A1 * | 2/2006 | Kim | 220/713 |
| 2006/0124645 | A1 | 6/2006 | Peitersen | |
| 2007/0062942 | A1 * | 3/2007 | Samson et al. | 220/203.11 |
| 2009/0108003 | A1 * | 4/2009 | Tripsianes | 220/521 |
| 2009/0108006 | A1 * | 4/2009 | Milan | 220/592.17 |
| 2009/0188929 | A1 * | 7/2009 | Sims et al. | 220/710 |
| 2011/0114655 | A1 * | 5/2011 | Bailey | 220/713 |

FOREIGN PATENT DOCUMENTS

WO 2009055067 A2 4/2009

* cited by examiner

*Primary Examiner* — Fenn Mathew
*Assistant Examiner* — Andrew T Kirsch
(74) *Attorney, Agent, or Firm* — Buche & Associates, PC; John K Buche

(57) ABSTRACT

A beverage lid system structured and arranged to assist shifting the temperature of a consumable liquid towards room temperature prior to delivery to the mouth of a consumer.

7 Claims, 8 Drawing Sheets

DRINKING VESSEL LID SYSTEMS

CROSS-REFERENCE TO RELATED APPLICATION

The present application is related to and claims priority from prior provisional application Ser. No. 61/441,212, filed Feb. 9, 2011, entitled "DRINKING VESSEL LID SYSTEMS"; and, this application is related to and claims priority from prior provisional application Ser. No. 61/450,043, filed Mar. 7, 2011, entitled "DRINKING VESSEL LID SYSTEMS", the contents of all of which are incorporated herein by this reference and are not admitted to be prior art with respect to the present invention by the mention in this cross-reference section.

BACKGROUND

This invention relates to providing a system for improved hot liquid drinking systems. More particularly, this invention relates to providing a cover for a beverage container which assists shifting the temperature of at least one portion of consumable liquid toward room temperature prior to delivery from the drinking vessel to a consumer. More particularly, this invention relates to providing a cover for a drinking vessel which promotes thermal exchange between at least one portion of consumable liquid and the surrounding environment prior to delivery from the beverage container to a consumer. While drinking a hot beverage such as coffee, tea, or hot chocolate, a consumer may experience physical discomfort due to sipping a beverage which is too hot. Alternatively, while drinking a cold beverage such as frozen coffee, smoothie, or milk shake, a consumer may experience physical discomfort due to sipping a beverage which is too cold. Therefore, a need exists for a system which assists shifting the temperature of a portion of consumable liquid towards room temperature prior to delivery to the mouth of the consumer, in order to prevent burning or freezing of the mouth of the consumer.

OBJECTS AND FEATURES OF THE INVENTION

A primary object and feature of the present invention is to provide a system overcoming the above-mentioned problem.

It is a further object and feature of the present invention to provide such a system to cover at least one beverage container containing a consumable liquid. Another primary object and feature of the present invention is to provide such a system to assist shifting the temperature of at least one portion of consumable liquid toward room temperature prior to delivery from a beverage container to a consumer.

Another object and feature of the present invention is to provide such a system to cover at least one beverage container which comprises at least one fluid-transport pathway for transporting at least portion of consumable liquid from at least one beverage container to a consumer. Yet another object and feature of the present invention is to provide such a system to cover at least one beverage container which provides a plurality of reservoirs to at least temporarily hold at least one portion of consumable liquid prior to delivery from a beverage container to a consumer. Yet another object and feature of the present invention is to provide such a system to cover at least one beverage container which provides a plurality of flow channels to assist flow of at least one portion of consumable liquid between a plurality of reservoirs prior to delivery from a beverage container to a consumer.

Yet another primary object and feature of the present invention is to provide such a system to assist increasing the surface area of at least one portion of a consumable liquid exposed to the surrounding environment prior to delivery from a beverage container to the consumer. Yet another primary object and feature of the present invention is to provide such a system to promote thermal exchange between at least one portion of consumable liquid and the surrounding environment prior to delivery from a beverage container to the consumer.

Another object and feature of the present invention is to provide such a system to assist preventing the burning of the mouth of the consumer upon drinking at least one portion of consumable liquid from a drinking vessel. Yet another object and feature of the present invention is to provide such a system to prevent freezing of the mouth the consumer upon drinking at least one portion of consumable liquid from a drinking vessel.

Another object and feature of the present invention is to provide such a system which provides at least one sipping orifice from which a consumer may drink at least one portion of consumable liquid, having temperature disposed towards room temperature, from a drinking vessel. Yet another object and feature of the present invention is to provide such a system which provides at least one second sipping orifice from which a consumer may drink at least one portion of consumable liquid directly from a drinking vessel.

Another object and feature of the present invention is to provide such a system which self-replenishes at least one portion of consumable liquid upon delivery of at least one portion of consumable liquid, having a temperature disposed towards room temperature, from a beverage container to a consumer. Another object and feature of the present invention is to provide such a system to cover at least one beverage container which uses gravity assistance to assist the flow of at least one portion of consumable liquid through at least one fluid-transfer pathway prior to delivery from a beverage container to a consumer.

A further primary object and feature of the present invention is to provide such a system that is efficient, inexpensive, and handy. Other objects and features of this invention will become apparent with reference to the following descriptions.

SUMMARY OF THE INVENTION

A system, relating to assisting thermal exchange between at least one portion of at least one fluid from at least one beverage container and the external environment to provide to at least consumer at least one sip of the at least one fluid with temperature disposed towards room temperature, comprising: at least one cover structured and arranged to cover at least one opening of the at least one beverage container containing the at least one fluid; wherein such at least one cover comprises at least one fluid-transport pathway structured and arranged to transfer at least one portion of the at least one fluid from the at least one beverage container to the at least consumer; wherein such at least one fluid-transport pathway comprises at least one temperature biaser structured and arranged to bias the temperature of the at least one portion of the at least one fluid towards room temperature during such transfer by such at least one fluid-transport pathway; wherein such at least one temperature biaser comprises within such at least one fluid-transport pathway, at least one plurality of reservoirs structured and arranged to at least temporarily hold the at least one portion of the at least one fluid, transferred from the at least one beverage container to such at least one cover, and at least one plurality of flow channels structured and arranged to channel the at least one portion of the at least one fluid to flow between such at least one plurality of reservoirs; wherein such at least one fluid-transport pathway comprises at least one flow assistor structured and arranged to assist flow of the at least one portion of the at least one fluid, transferred from the at least one beverage container to such at least one cover, through such at least one plurality of reservoirs and through such at least one plurality of flow channels; wherein such at least one plurality of reservoirs comprises at least three reservoirs; and wherein such at least one cover provides to the at least one consumer the at least one sip of the at least one fluid with temperature disposed towards room temperature.

Moreover, it provides such a system wherein such at least one cover further comprises at least one self-replenisher structured and arranged to self-replenish such at least one fluid-transport pathway with at least one additional portion of the at least one fluid from the at least one beverage container while providing to the at least one consumer the at least one sip of the at least one fluid with temperature disposed towards room temperature. Additionally, it provides such a system wherein such wherein such at least one temperature biaser further comprises: at least one surface-area maximizer structured and arranged to maximize the surface area of the at least one portion of the at least one fluid transferred by such at least one fluid-transport pathway; wherein such at least one surface area maximizer promotes thermal exchange between the at least one portion of the at least one fluid with the external environment. Also, it provides such a system wherein such at least one cover further comprises, in fluid communication with such at least one fluid-transport pathway, at least one first sipping orifice structured and arranged to provide an opening for the at least one consumer to drink the at least one sip of the at least one fluid having a temperature disposed towards room temperature.

In addition, it provides such a system wherein such at least one cover comprises at least one fluid-loading aperture structured and arranged to provide aperture-assisted loading of the at least one portion of the at least one fluid from the at least one beverage container to such at least one fluid-transport pathway. And, it provides such a system wherein: such at least one fluid-transport pathway is further structured and arranged to assist such transfer of the at least one portion of the at least one fluid from the at least one beverage container to such at least one first sipping orifice by tipping the at least one beverage container, while covered by such at least one cover, from a generally upright position to at least one non-upright position biased towards such at least one sipping orifice. Further, it provides such a system further comprising: at least one second sipping orifice structured and arranged to provide an opening for the at least one consumer to drink the at least one portion of the at least one fluid directly from the at least one beverage container; and wherein the at least one consumer may choose to drink from such at least one first sipping orifice or from such at least one second sipping orifice.

Even further, it provides such a system wherein such at least one plurality of reservoirs comprises: at least one receiving reservoir structured and arranged to receive the at least one portion of the at least one fluid from the at least one beverage container transferred from the at least one beverage container through such at least one transfer passage; in fluid communication with such at least one receiving reservoir, at least one transfer reservoir structured and arranged to receive the at least one portion of the at least one fluid from such at least one collecting reservoir; and in fluid communication with such at least one transfer reservoir, at least one storage reservoir structured and arranged to store such at least one portion of the at least one fluid received from such at least one transfer reservoir. Moreover, it provides such a system wherein such at least one collecting reservoir comprises at least first receiving reservoir and at least one second receiving reservoir symmetrically disposed around the periphery of such at least one cover.

Additionally, it provides such a system wherein such at least one transfer reservoir comprises at least one first transfer reservoir and at least one second transfer reservoir symmetrically disposed around the periphery of such at least one cover. Also, it provides such a system wherein: such at least one storage reservoir comprises at least one volume capacity limiter structured and arranged to limit the volume of the at least one portion of the at least one fluid stored by such at least one storage reservoir; and wherein such at least one volume capacity limiter limits the volume of the at least one sip of the at least one fluid with temperature disposed towards room temperature provided to the at least one consumer by such at least one cover. In addition, it provides such a system wherein such at least one temperature biaser further comprises: at least one mixer structured and arranged to mix the at least one portion of the at least one fluid flowing through such at least one fluid-transport pathway; and wherein such at least one mixer promotes thermal exchange between the at least one portion of the at least one fluid flowing through such at least one mixing flow channel and the external environment. And, it provides such a system wherein such at least one mixer comprises at least three surface protrusions projecting outwardly into such at least one fluid-transport pathway.

Further, it provides such a system wherein: such at least one plurality of flow channels comprises at least one mixing flow channel structured and arranged to comprise such at least one mixer; and such at least one mixing flow channel is disposed between such at least one transfer reservoir and such at least one storage reservoir. Even further, it provides such a system wherein such at least one mixing flow channel comprises at least one first mixing flow channel and at least one second mixing flow channel symmetrically disposed around the periphery of such at least one cover. Moreover, it provides such a system wherein such at least one mixing flow channel comprises at least one slope structured and arranged to assist flow of the at least one portion of the at least one fluid between such at least one transfer reservoir and such at least one storage reservoir. Additionally, it provides such a system wherein such at least one slope of such at least one mixing flow channel comprises and angle of about a 12° relative to horizontal. Also, it provides such a system wherein such at least one receiving reservoir, such least one transfer reservoir, and such at least one mixing flow channel are each geometrically configured to provide gravity-assisted sequential flow of the at least one portion of the at least one fluid from such at least one receiving reservoir to such at least one transfer reservoir to such at least one mixing flow channel to such at least one storage reservoir when such at least one cover is placed in about a horizontal position.

In addition, it provides such a system wherein such at least one plurality of flow channels comprises at least one central flow channel structured and arranged to provide at least one route to assist the at least one portion of the at least one fluid to flow from such at least one storage reservoir to such at least one first sipping orifice. And, it provides such a system wherein flow of the at least one portion of the at least one fluid through such at least one central flow channel to such at least one first sipping is assisted by tipping such at least one beverage container, covered by such at least one cover, from the generally upright position to the at least one non-upright position biased towards such at least one sipping orifice.

Further, it provides such a system wherein such at least one cover comprises: at least one first barrier structured and arranged to provide at least one first barrier between the at least one fluid contained in the at least one beverage container and the external environment; and at least one second barrier structured and arranged to provide at least one second barrier between the at least one fluid contained in the at least one beverage container and the external environment. Even further, it provides such a system further comprising at least one first securer structured and arranged to secure such at least one first barrier to a rim portion of such at least one beverage container.

Moreover, it provides such a system further comprising at least one second securer structured and arranged to secure such at least one first barrier to such at least one second barrier. Additionally, it provides such a system further comprising at least one coupler structured and arranged to couple such at least one first barrier to such at least one second barrier. Also, it provides such a system wherein such at least one coupler comprises at least one hinge.

In accordance with another preferred embodiment hereof, this invention provides a system, relating to assisting thermal exchange between at least one portion of at least one fluid from at least one beverage container and the external environment to provide to at least consumer at least one sip of the at least one fluid with temperature disposed towards room temperature, comprising: cover means for covering at least one opening of the at least one beverage container containing the at least one fluid; wherein such cover means comprises fluid-transport pathway means for transferring at least one portion of the at least one fluid from the at least one beverage container to the at least consumer; wherein such fluid-transport pathway means comprises temperature biaser means for biasing the temperature of the at least one portion of the at least one fluid towards room temperature during such transfer by such fluid-transport pathway means; wherein such temperature biaser means comprises within such fluid-transport pathway means, a plurality of reservoir means for at least temporarily holding the at least one portion of the at least one fluid, transferred from the at least one beverage container to such cover means, and a plurality of flow channel means for channeling the at least one portion of the at least one fluid to flow between such plurality of reservoir means; wherein such fluid-transport pathway means comprises flow assistor means for assisting flow of the at least one portion of the at least one fluid, transferred from the at least one beverage container to such cover means, through such plurality of reservoir means and through such plurality of flow channel means; wherein such plurality of reservoir means comprises at least three reservoirs; and wherein such cover means provides to the at least one consumer the at least one sip of the at least one fluid with temperature disposed towards room temperature. In addition, it provides such a system wherein such cover means comprises self-replenisher means for self-replenishing such fluid-transport pathway means with at least one additional portion of the at least one fluid from the at least one beverage container while providing to the at least one consumer the at least one sip of the at least one fluid with temperature disposed towards room temperature.

In accordance with another preferred embodiment hereof, this invention provides a system, relating to assisting thermal exchange between at least one portion of at least one fluid from at least one beverage container and the external environment to provide to at least consumer at least one sip of the at least one fluid with temperature disposed towards room temperature, comprising: cover means for covering at least one opening of the at least one beverage container containing the at least one fluid; wherein such cover means comprises a plurality of reservoir means for at least temporarily holding the at least one portion of the at least one fluid when transferred from the at least one beverage container to such cover means; wherein such cover means comprises a plurality of flow channel means for providing at least one plurality of routes for the at least one portion of the at least one fluid to flow between such plurality of reservoir means; wherein such cover means comprises temperature biaser means for biasing the temperature of the at least one portion of the at least one fluid, when transferred from the at least one beverage container to such cover means, towards room temperature; wherein such temperature biaser means comprises flow assistor means for assisting flow of the at least one portion of the at least one fluid, when transferred from the at least one beverage container to such cover means, through such plurality of reservoir means and through such plurality of flow channel means; wherein such cover means provides to the at least one consumer the at least one sip of the at least one fluid with temperature disposed towards room temperature; and wherein such cover means comprises self-replenisher means for self-replenishing such plurality of reservoir means and such plurality of flow channel means with at least one additional portion of the at least one fluid from the at least one beverage container while providing to the at least one consumer the at least one sip of the at least one fluid with temperature disposed towards room temperature.

In accordance with another preferred embodiment hereof, this invention provides a system, relating to assisting thermal exchange between at least one portion of at least one fluid from at least one beverage container and the external environment to provide to at least consumer at least one sip of the at least one fluid with temperature disposed towards room temperature, comprising: cover means for covering at least one opening of the at least one beverage container containing the at least one fluid; wherein such cover means comprises fluid-transport pathway means for transferring at least one portion of the at least one fluid from the at least one beverage container to the at least consumer; wherein such fluid-transport pathway means comprises temperature biaser means for biasing the temperature of the at least one portion of the at least one fluid towards room temperature during such transfer by such fluid-transport pathway means; wherein such temperature biaser means comprises within such fluid-transport pathway means, a plurality of reservoir means for at least temporarily holding the at least one portion of the at least one fluid, transferred from the at least one beverage container to such cover means, and a plurality of flow channel means for channeling the at least one portion of the at least one fluid to flow between such plurality of reservoir means; wherein such fluid-transport pathway means comprises flow assistor means for assisting flow of the at least one portion of the at least one fluid, transferred from the at least one beverage container to such cover means, through such plurality of reservoir means and through such plurality of flow channel means; wherein such cover means comprises first sipping orifice means for providing an opening for the at least one consumer to drink the at least one sip of the at least one fluid having a temperature disposed towards room temperature, and second sipping orifice means for providing an opening for the at least one consumer to drink the at least one portion of the at least one fluid directly from the at least one beverage container; and wherein the at least one consumer may choose to drink from such first sipping orifice means or from such second sipping orifice means.

In accordance with another preferred embodiment hereof, this invention provides a system, relating to assisting thermal exchange between at least one portion of at least one fluid from at least one beverage container and the external environment to provide to at least consumer at least one sip of the at least one fluid with temperature disposed towards room temperature, comprising: at least one cover structured and arranged to cover at least one opening of the at least one beverage container containing the at least one fluid; wherein such at least one cover comprises at least one plurality of reservoirs structured and arranged to at least temporarily hold the at least one portion of the at least one fluid, transferred from the at least one beverage container to such at least one cover; wherein such at least one cover comprises at least one plurality of flow channels structured and arranged to provide at least one plurality of routes for the at least one portion of the at least one fluid to flow between such at least one plurality of reservoirs; wherein such at least one cover comprises at least one temperature biaser structured and arranged to bias the temperature of the at least one portion of the at least one fluid, transferred from the at least one beverage container to such at least one cover, towards room temperature; wherein such at least one temperature biaser comprises at least one flow assistor structured and arranged to assist flow of the at least one portion of the at least one fluid, transferred from the at least one beverage container to such at least one cover, through such at least one plurality of reservoirs and through such at least one plurality of flow channels; wherein such at least one plurality of reservoirs comprises at least three reservoirs; and wherein such at least one cover provides to the at least one consumer the at least one sip of the at least one fluid with temperature disposed towards room temperature. And, it provides such a system wherein such at least one cover comprises at least one self-replenisher structured and arranged to self-replenish such at least one plurality of reservoirs and such at least one plurality of flow channels with at least one additional portion of the at least one fluid from the at least one beverage container while providing to the at least one consumer the at least one sip of the at least one fluid with temperature disposed towards room temperature. Further, it provides such a system wherein such at least one flow assistor comprises: at least one surface area maximizer structured and arranged to maximize the surface area of the at least one portion of the at least one fluid transferred from the at least one beverage container to such at least one cover; wherein such at least one surface area maximizer promotes thermal exchange between the at least one portion of the at least one fluid transferred from the at least one beverage container to such at least one cover and the external environment.

Even further, it provides such a system wherein such at least one temperature biaser assists preventing the burning of the mouth of the at least one consumer. Moreover, it provides such a system wherein such at least one temperature biaser assists preventing the freezing of the mouth of the at least one consumer. Additionally, it provides such a system wherein such at least one cover comprises at least one first sipping orifice structured and arranged to provide an opening for the at least one consumer to drink the at least one sip of the at least one fluid with temperature disposed towards room temperature. Also, it provides such a system wherein such at least one cover means comprises at least one transferrer structured and arranged to transfer the at least one portion of the at least one fluid from the at least one beverage container to such at least one cover. In addition, it provides such a system wherein transfer of the at least one portion of the at least one fluid from the at least one beverage container to such at least one cover by such at least one transferrer is assisted by tipping such at least one beverage container, while covered by such at least one cover, from the horizontal position towards such at least one sipping orifice. And, it provides such a system further comprising: at least one second sipping orifice structured and arranged to provide an opening for the at least one consumer to drink the at least one portion of the at least one fluid directly from the at least one beverage container; and wherein the at least one consumer may choose to drink from such at least one first sipping orifice or from such at least one second sipping orifice.

Further, it provides such a system wherein such at least one plurality of reservoirs comprises: at least one collecting reservoir structured and arranged to collect the at least one portion of the at least one fluid from the at least one beverage container transferred by such at least one transferrer; at least one transfer reservoir structured and arranged to receive the at least one portion of the at least one fluid from such at least one collecting reservoir; and at least one second storage reservoir structured and arranged to store such at least one portion of the at least one fluid received from such at least one transfer reservoir. Even further, it provides such a system wherein such at least one collecting reservoir comprises at least first collecting reservoir and at least one second collecting reservoir symmetrically disposed around the periphery of such at least one cover.

Moreover, it provides such a system wherein such at least one transfer reservoir comprises at least one first transfer reservoir and at least one second transfer reservoir symmetrically disposed around the periphery of such at least one cover. Additionally, it provides such a system wherein: such at least one second storage reservoir comprises at least one volume capacity limiter structured and arranged to limit the volume of the at least one portion of the at least one fluid stored by such at least one second storage reservoir; and wherein such at least one volume capacity limiter limits the volume of the at least one sip of the at least one fluid with temperature disposed towards room temperature provided to the at least one consumer by such at least one cover. Also, it provides such a system wherein such at least one plurality of flow channels comprises: at least one mixing flow channel structured and arranged to provide at least one route for the at least one portion of the at least one fluid to flow between such at least one transfer reservoir and such at least one second storage reservoir; wherein such at least one mixing flow channel comprises at least one mixer structured and arranged to mix the at least one portion of the at least one fluid flowing through such at least one mixing flow channel; and wherein such at least one mixer promotes thermal exchange between the at least one portion of the at least one fluid flowing through such at least one mixing flow channel and the external environment. In addition, it provides such a system wherein such at least one mixer comprises at least three surface protrusions in such at least one mixing flow channel.

And, it provides such a system wherein such at least one mixing flow channel comprises at least one first mixing flow channel and at least one second mixing flow channel symmetrically disposed around the periphery of such at least one cover. Further, it provides such a system wherein such at least one mixing flow channel comprises at least one slope structured and arranged to assist flow of the at least one portion of the at least one fluid between such at least one transfer reservoir and such at least one second storage reservoir. Even further, it provides such a system wherein such at least one slope slopes downward at about a 12° angle relative to horizontal. Moreover, it provides such a system wherein: such at least one transfer reservoir is geometrically disposed beneath such at least one collecting reservoir; such at least one mixing flow channel is geometrically disposed beneath such at least one transfer reservoir; such at least one second storage reservoir is geometrically disposed beneath such at least one mixing flow channel; and wherein gravity assists sequential flow of the at least one portion of the at least one fluid from such at least one collecting reservoir to such at least one transfer reservoir to such at least one mixing flow channel to such at least one second storage reservoir when such at least one cover is held in a horizontal position.

Additionally, it provides such a system wherein such at least one plurality of flow channels comprises at least one central flow channel structured and arranged to provide at least one route for the at least one portion of the at least one fluid to flow from such at least one second storage reservoir to such at least one first sipping orifice. Also, it provides such a system wherein flow of the at least one portion of the at least one fluid through such at least one central flow channel to such at least one first sipping is assisted by tipping such at least one beverage container, covered by such at least one cover, from the horizontal position towards such at least one first sipping orifice. In addition, it provides such a system wherein such at least one cover means comprises: at least one first barrier structured and arranged to provide at least one first barrier between the at least one fluid contained in the at least one beverage container and the external environment; and at least one second barrier structured and arranged to provide at least one second barrier between the at least one fluid contained in the at least one beverage container and the external environment. And, it provides such a system further comprising at least one first securer structured and arranged to secure such at least one first barrier to the rim of such at least one beverage container. Further, it provides such a system further comprising at least one second securer structured and arranged to secure such at least one first barrier to such at least one second barrier. Even further, it provides such a system further comprising at least one coupler structured and arranged to couple such at least one first barrier to such at least one second barrier. Moreover, it provides such a system wherein such at least one coupler comprises at least one hinge.

In accordance with another preferred embodiment hereof, this invention provides a system, relating to assisting thermal exchange between at least one portion of at least one fluid from at least one beverage container and the external environment to provide to at least consumer at least one sip of the at least one fluid with temperature disposed towards room temperature, comprising: cover means for covering at least one opening of the at least one beverage container containing the at least one fluid; wherein such cover means comprises a plurality of reservoir means for at least temporarily holding the at least one portion of the at least one fluid transferred from the at least one beverage container to such cover means; wherein such cover means comprises a plurality of flow channel means for providing at least one plurality of routes for the at least one portion of the at least one fluid to flow between such plurality of reservoir means; wherein such cover means comprises temperature biaser means for biasing the temperature of the at least one portion of the at least one fluid, transferred from the at least one beverage container to such cover means, towards room temperature; wherein such temperature biaser means comprises flow assistor means for assisting flow of the at least one portion of the at least one fluid, transferred from the at least one beverage container to such cover means, through such plurality of reservoir means and through such plurality of flow channel means; wherein such plurality of reservoir means comprises at least three reservoirs; and wherein such cover means provides to the at least one consumer the at least one sip of the at least one fluid with temperature disposed towards room temperature. Additionally, it provides such a system wherein such cover means comprises self-replenisher means for self-replenishing such plurality of reservoir means and such plurality of flow channel means with at least one additional portion of the at least one fluid from the at least one beverage container while providing to the at least one consumer the at least one sip of the at least one fluid with temperature disposed towards room temperature. Also, it provides such a system wherein such flow assistor means comprises: surface area maximizer means for maximizing the surface area of the at least one portion of the at least one fluid transferred from the at least one beverage container to such cover means; wherein such surface area maximizer means promotes thermal exchange between the at least one portion of the at least one fluid transferred from the at least one beverage container to such cover means and the external environment.

In addition, it provides such a system wherein such temperature biaser means assists preventing the burning of the mouth of the at least one consumer. And, it provides such a system wherein such temperature biaser means assists preventing the freezing of the mouth of the at least one consumer. Further, it provides such a system wherein such cover means comprises transferrer means for transferring the at least one portion of the at least one fluid from the at least one beverage container to such cover means. Even further, it provides such a system wherein such cover means comprises first sipping orifice means for providing an opening for the at least one consumer to drink the at least one sip of the at least one fluid with temperature disposed towards room temperature. Even further, it provides such a system further comprising: second sipping orifice means for providing an opening for the at least one consumer to drink the at least one portion of the at least one fluid directly from the at least one beverage container; wherein the at least one consumer may choose to drink from such first sipping orifice means or from such second sipping orifice means. Even further, it provides such a system wherein such plurality of reservoir means comprises: collecting reservoir means for collecting the at least one portion of the at least one fluid from the at least one beverage container transferred by such transferrer means; transfer reservoir means for receiving the at least one portion of the at least one fluid from such collecting reservoir means; and second storage reservoir means for storing such at least one portion of the at least one fluid received from such transfer reservoir means.

Even further, it provides such a system wherein: such second storage reservoir means comprises volume capacity limiter means for limiting the volume of the at least one portion of the at least one fluid stored by such second storage reservoir means; and wherein such volume capacity limiter means limits the volume of the at least one sip of the at least one fluid. Even further, it provides such a system wherein such plurality of flow channel means comprises: mixing flow channel means for providing at least one route for the at least one portion of the at least one fluid to flow between such transfer reservoir means and such second storage reservoir means; wherein such mixing flow channel means comprises mixer means for mixing the at least one portion of the at least one fluid flowing through such mixing flow channel means; and wherein such mixer means promotes thermal exchange between the at least one portion of the at least one fluid flowing through such mixing flow channel means and the external environment. Even further, it provides such a system wherein such mixer means comprises at least three surface protrusions in such mixing flow channel means. Even further, it provides such a system wherein: such transfer reservoir means is geometrically disposed beneath such collecting reservoir means; such mixing flow channel means is geometrically disposed beneath such transfer reservoir means; such second storage reservoir is geometrically disposed beneath such mixing flow channel means; and wherein gravity assists sequential flow of the at least one portion of the at least one fluid from such collecting reservoir means to such transfer reservoir means to such mixing flow channel means to such second storage reservoir means when such cover means is held in a horizontal position.

Even further, it provides such a system wherein such plurality of flow channel means comprises central flow channel means for providing at least one route for the at least one portion of the at least one fluid to flow from such second storage reservoir means and such first sipping orifice means. Even further, it provides such a system wherein such cover means further comprises: first barrier means for providing at least one first barrier between the at least one fluid contained in the at least one beverage container and the external environment; and second barrier means for providing at least one second barrier between the at least one fluid contained in the at least one beverage container and the external environment. Even further, it provides such a system further comprising coupler means for coupling such first barrier means to such second barrier means.

In accordance with another preferred embodiment hereof, this invention provides a system, relating to assisting thermal exchange between at least one portion of at least one fluid from at least one beverage container and the external environment to provide to at least consumer at least one sip of the at least one fluid with temperature disposed towards room temperature, comprising: cover means for covering at least one opening of the at least one beverage container containing the at least one fluid; wherein such cover means comprises a plurality of reservoir means for at least temporarily holding the at least one portion of the at least one fluid when transferred from the at least one beverage container to such cover means; wherein such cover means comprises a plurality of flow channel means for providing at least one plurality of routes for the at least one portion of the at least one fluid to flow between such plurality of reservoir means; wherein such cover means comprises temperature biaser means for biasing the temperature of the at least one portion of the at least one fluid, when transferred from the at least one beverage container to such cover means, towards room temperature; wherein such temperature biaser means comprises flow assistor means for assisting flow of the at least one portion of the at least one fluid, when transferred from the at least one beverage container to such cover means, through such plurality of reservoir means and through such plurality of flow channel means; wherein such cover means provides to the at least one consumer the at least one sip of the at least one fluid with temperature disposed towards room temperature; and wherein such cover means comprises self-replenisher means for self-replenishing such plurality of reservoir means and such plurality of flow channel means with at least one additional portion of the at least one fluid from the at least one beverage container while providing to the at least one consumer the at least one sip of the at least one fluid with temperature disposed towards room temperature.

In addition, this invention provides and every novel feature, element, combination, step and/or method disclosed or suggested by this patent application.

DETAILED DESCRIPTION OF THE BEST MODES AND PREFERRED EMBODIMENTS OF THE INVENTION

Figure 1A:
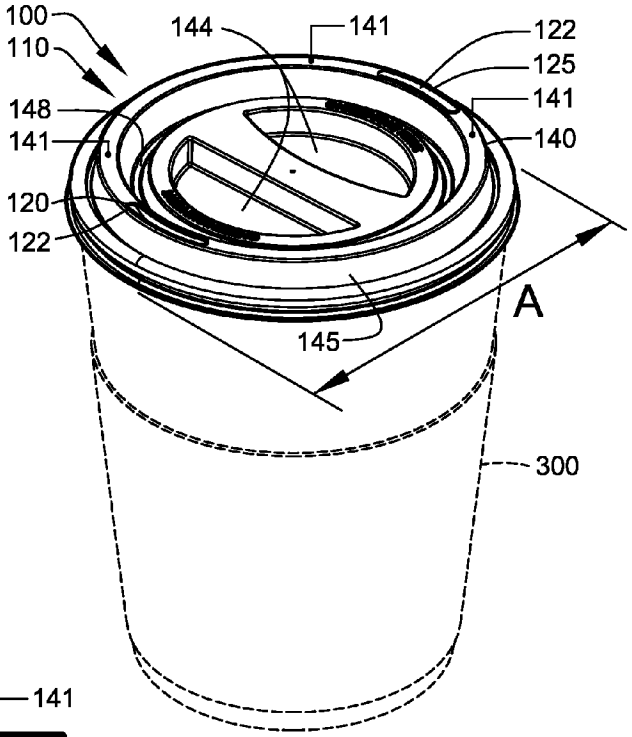
FIG. 1A shows a perspective view, illustrating a beverage lid of the beverage lid system secured to a drinking vessel, according to a preferred embodiment of the present invention.
Figure 1B:
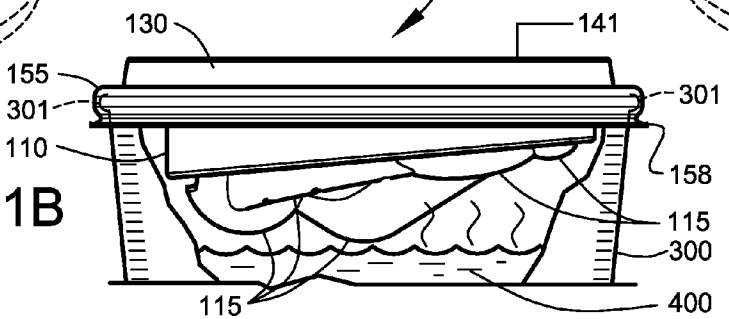
FIG. 1B shows a cut-away view, illustrating the beverage lid secured to the drinking vessel, according to the preferred embodiment of FIG. 1A.

FIG. 1A shows a perspective view, illustrating beverage lid 110 of beverage lid system 100 secured to beverage container 300, according to a preferred embodiment of the present invention. FIG. 1B shows a cut-away view, illustrating beverage lid 110 secured to beverage container 300, according to the preferred embodiment of FIG. 1A. Beverage lid 110 (at least embodying herein at least one cover structured and arranged to cover at least one opening of the at least one beverage container containing the at least one fluid; and at least embodying herein) preferably provides a cover for at least one beverage container 300, as shown. Drinking vessel 300 (shown in FIG. 1A using dashed lines) preferably holds at least one consumable liquid 400 (as shown in FIG. 1B). Consumable liquid 400 preferably comprises at least one beverage, preferably at least one hot beverage such as, for example, coffee, tea, or hot chocolate. Alternatively preferably, consumable liquid 400 preferably comprises at least one cold beverage such as, for example, ice-blended coffee, smoothie, milk shake, or cold carbonated beverage. Alternatively preferably, consumable liquid 400 comprises at least one liquid food, such as, for example, soup. Upon reading this specification, those with ordinary skill in the art will now appreciate that, under appropriate circumstances, considering such issues as design preference, user preferences, manufacturing preferences, cost, structural requirements, available materials, technological advances, etc., other consumable liquids such as, for example, hot cider, hot wine, hot alcoholic beverages, cold fruit juice, ice water, iced coffee, cold beer, other hot or cold beverages, etc., may suffice.

Beverage lid 110 preferably is structured and arranged to preferably assist shifting the temperature of consumable liquid 400 closer to room temperature in order to preferably assist preventing the burning of the mouth of the consumer, alternatively preferably to assist preventing the freezing of the mouth of the consumer. This arrangement preferably assists protecting the consumer from physical discomfort which may arise from drinking a beverage which is too hot or too cold.

Beverage lid 110 preferably assists shifting of the temperature of consumable liquid 400 towards room temperature by a stepwise process, which preferably is designed to promote thermal exchange between the surrounding environment and at least one portion of consumable liquid 400 being delivered to the mouth of the consumer (see details below). Beverage lid 110 preferably comprises at least one fluid-transport pathway 164 (at least herein embodying wherein such at least one cover comprises at least one fluid-transport pathway structured and arranged to transfer at least one portion of the at least one fluid from the at least one beverage container to the at least consumer) preferably configured to transport portions of consumable liquid 400 from beverage container 300 to the mouth of the consumer. Fluid-transport pathway 164 preferably comprises a plurality of cooling contours 115 (as shown in FIG. 1B) which preferably are involved in the thermal exchange function of the present invention (see details below). Incorporation of such cooling contours 115 within fluid-transport pathway 164 preferably produces, within beverage lid 110, a temperature "biaser" 112 preferably functioning to "bias" the temperature of consumable liquid 400 towards room temperature as the liquid flows through beverage lid 110 to the mouth of the consumer (at least embodying herein wherein such at least one fluid-transport pathway comprises at least one temperature biaser structured and arranged to bias the temperature of the at least one portion of the at least one fluid towards room temperature during such transfer by such at least one fluid-transport pathway). The temperature shifting function of beverage lid 110 preferably is initiated when the consumer tips beverage container 300 towards his or her mouth for drinking (see details below).

Beverage lid 110 further preferably provides a physical barrier to preferably assist maintaining the desired temperature of consumable liquid 400 while contained in beverage container 300. In addition, beverage lid 110 preferably provides a barrier to preferably assist preventing spilling of consumable liquid 400 from beverage container 300.

Beverage lid 110 preferably is structured and arranged to removeably secure to the annular rim 301 of beverage container 300, as shown in FIG. 1A and FIG. 1B. The size and dimensions of beverage lid 110 preferably is designed to match the size and dimensions of the rim 301 of beverage container 300. In one preferred embodiment of the present invention, beverage lid 110 preferably comprises a diameter of about three and a half inches, as shown by dimension A in FIG. 1A. Upon reading this specification, those with ordinary skill in the art will now appreciate that, under appropriate circumstances, considering such issues as design preference, user preferences, manufacturing preferences, cost, structural requirements, available materials, etc., other size arrangements such as, for example, larger, smaller, etc., may suffice.

Drinking vessel 300 preferably comprises at least one drinking cup, preferably at least one portable drinking cup, preferably at least one portable and disposable drinking cup, such as the paper or Styrofoam cups received from a coffee house, a fast-food restaurant, or other restaurant. Upon reading this specification, those with ordinary skill in the art will now appreciate that, under appropriate circumstances, considering such issues as design preference, user preferences, manufacturing preferences, cost, structural requirements, available materials, etc., other drinking vessel types such as, for example, plastic disposable cups, non-disposable cups, mugs, etc., may suffice.

Beverage lid 110 preferably is configured to be disposable after a single use. Upon reading this specification, those with ordinary skill in the art will now appreciate that, under appropriate circumstances, considering such issues as design preference, user preferences, manufacturing preferences, cost, structural requirements, available materials, etc., other arrangements such as, for example, non-disposable lids, etc., may suffice.

Beverage lid 110 preferably comprises plastic polymeric material, preferably polystyrene. Upon reading this specification, those with ordinary skill in the art will now appreciate that, under appropriate circumstances, considering such issues as design preference, user preferences, manufacturing preferences, cost, structural requirements, available materials, etc., other material arrangements such as, for example, paper, Styrofoam, etc., may suffice.

Beverage lid 110 preferably comprises at least one sipping orifice 122, as shown. Sipping orifice 122 preferably comprises at least one first sipping orifice 120 and at least one second sipping orifice 125, as shown. Upon reading this specification, those with ordinary skill in the art will now appreciate that, under appropriate circumstances, considering such issues as design preference, user preferences, manufacturing preferences, cost, structural requirements, available materials, etc., other liquid dispensing arrangements such as, for example, pull tab openings, straw apertures, etc., may suffice.

According to one preferred embodiment of the present invention, beverage lid 110 preferably further comprises at least one aperture plug structured and arranged to removeably plug at least one sipping orifice 122.

From first sipping orifice 120 (at least herein embodying wherein such at least one cover further comprises, in fluid communication with such at least one fluid-transport pathway, at least one first sipping orifice structured and arranged to provide an opening for the at least one consumer to drink the at least one sip of the at least one fluid having a temperature disposed towards room temperature), the consumer may preferably drink at least one portion of consumable liquid 400, which preferably has a temperature adjusted toward room temperature (see details below). For example, if consumable liquid 400 comprises hot coffee, a consumer may drink from first sipping orifice 120 to preferably drink at least one relatively cooled portion of coffee, with a temperature preferably shifted closer room temperature than the bulk of consumable liquid 400 contained in beverage container 300. Likewise, if consumable liquid 400 comprises iced coffee, a consumer may drink from first sipping orifice 120 to preferably drink a relatively warmed portion of coffee, with a temperature preferably shifted closer to room temperature than the bulk of consumable liquid 400 contained in beverage container 300.

Second sipping orifice 125 (at least embodying herein at least one second sipping orifice structured and arranged to provide an opening for the at least one consumer to drink the at least one portion of the at least one fluid directly from the at least one beverage container) preferably allows the consumer to drink directly from beverage container 300, preferably bypassing the temperature adjustment step (see details below). Second sipping orifice 125 preferably provides the consumer with at least one portion of consumable liquid 400 which preferably has a temperature closely matching the temperature of the bulk of consumable liquid 400 contained in beverage container 300. A consumer may choose to drink from second sipping orifice 125 after consumable liquid 400 has had sufficient time to cool, or warm, to room temperature, for example. This arrangement at least herein embodies wherein the at least one consumer may choose to drink from such at least one first sipping orifice or from such at least one second sipping orifice.

Figure 1C:
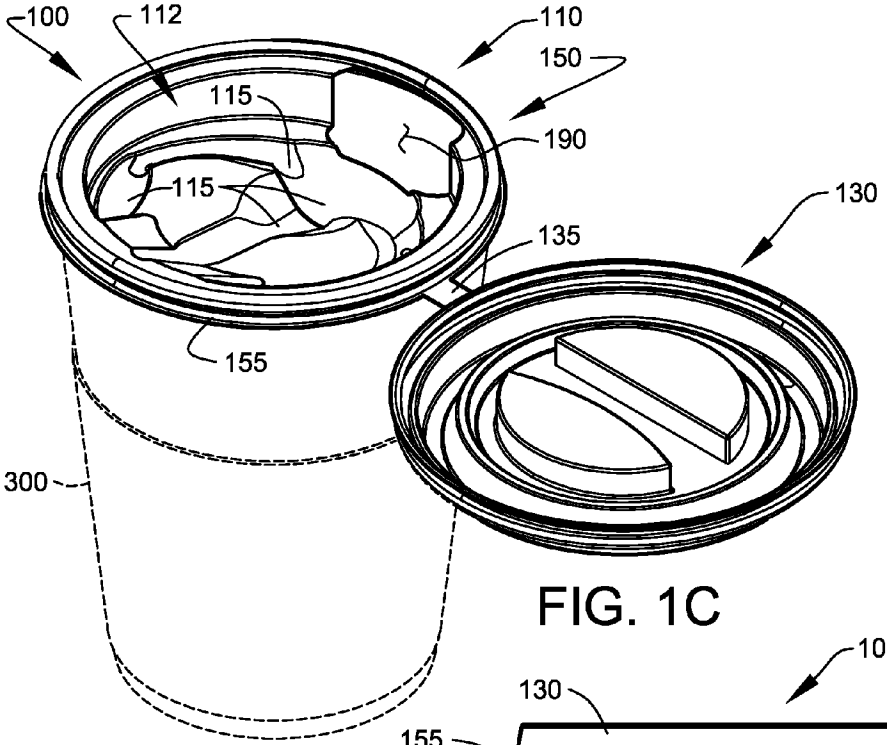
FIG. 1C shows a perspective view, illustrating the beverage lid secured to the beverage container with the internal barrier and the external barrier disconnected, according to the preferred embodiment of FIG. 1A.

Beverage lid 110 preferably comprises at least one internal barrier 150 and at least one external barrier 130, as best shown in FIG. 1C. External barrier 130 may preferably be repositioned from the decoupled position of FIG. 1C to a position of engagement with internal barrier 150, as shown in FIG. 1A. FIG. 1C shows a perspective view, illustrating beverage lid 110 secured to beverage container 300 with internal barrier 150 and external barrier 130 disconnected, according to the preferred embodiment of FIG. 1A.

Internal barrier 150 and external barrier 130 preferably are coupled by at least one hinge unit 135 (at least embodying herein at least one coupler structured and arranged to couple such at least one first barrier to such at least one second barrier), preferably comprising a living hinge formed integrally within beverage lid 110, as shown in FIG. 1C. Upon reading this specification, those with ordinary skill in the art will now appreciate that, under appropriate circumstances, considering such issues as design preference, user preferences, manufacturing preferences, cost, structural requirements, available materials, etc., other coupling arrangements such as, for example, living hinges, permanent coupling arrangements, etc., may suffice.

Figure 2A:
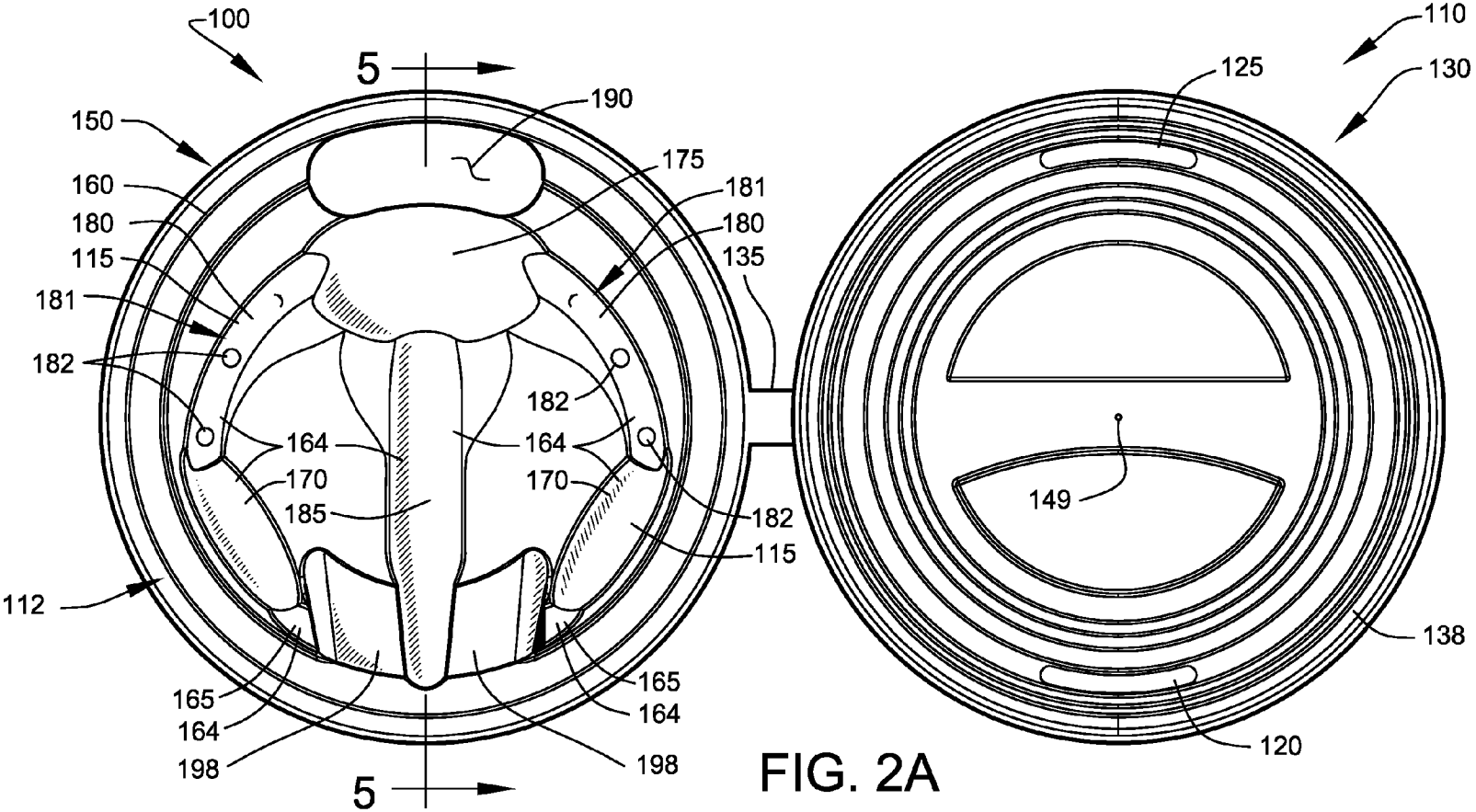
FIG. 2A shows a top view, illustrating the beverage lid with the internal barrier and the external barrier disconnected, according to the preferred embodiment of FIG. 1A.
Figure 2B:
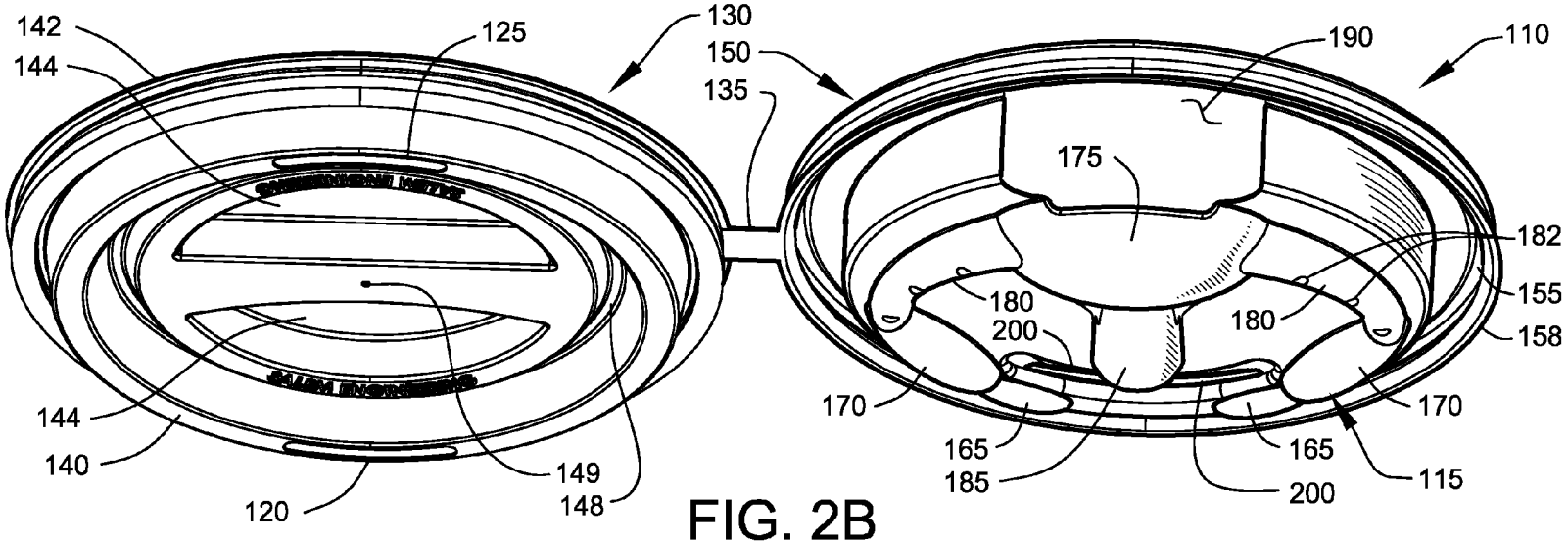
FIG. 2B shows a perspective view, illustrating the bottom of the beverage lid with the internal barrier and the external barrier disconnected, according to the preferred embodiment of FIG. 1A.

FIG. 2A shows a top view, illustrating beverage lid 110 with internal barrier 150 and external barrier 130 disconnected, according to the preferred embodiment of FIG. 1A. FIG. 2B shows a perspective view, illustrating the bottom of beverage lid 110 with internal barrier 150 and external barrier 130 disconnected, according to the preferred embodiment of FIG. 1A. Internal barrier 150 preferably comprises at least one annular gripping portion 155, as best shown in FIG. 2B, which preferably is structured and arranged to preferably grip rim 301 of beverage container 300 to preferably removeably secure internal barrier 150 to rim 301 of beverage container 300 (as best shown in FIG. 1C) (this arrangement at least embodying herein at least one first securer structured and arranged to secure such at least one first barrier to a rim portion of such at least one beverage container).

External barrier 130 (at least embodying herein at least one second barrier structured and arranged to provide at least one second barrier between the at least one fluid contained in the at least one beverage container and the external environment) preferably comprises at least one annular gripping portion 138 (this arrangement at least embodying herein at least one second securer structured and arranged to secure such at least one first barrier to such at least one second barrier), as best shown in FIG. 2A. Annular gripping portion 138 preferably is structured and arranged to preferably grip annular protrusion 160 of internal barrier 150 (as best shown in FIG. 2A) in order to preferably removeably connect external barrier 130 to internal barrier 150 (as best shown in FIG. 1A). Upon reading this specification, those with ordinary skill in the art will now appreciate that, under appropriate circumstances, considering such issues as design preference, user preferences, manufacturing preferences, cost, structural requirements, available materials, etc., other connecting arrangements such as, for example, other male/female type connectors, permanent connecting arrangements, etc., may suffice.

External barrier 130 preferably comprises at least one annular raised portion 140, as best shown in FIG. 1A and FIG. 2B. First sipping orifice 120 and second sipping orifice 125 preferably are both located on annular raised portion 140 of external barrier 130, as shown in FIG. 1A and FIG. 1B. Annular raised portion 140 preferably is structured and arranged to preferably assist preventing the lip of the consumer from contacting flared skirt 158 of internal barrier 150 (as best shown in FIG. 2B) or flared skirt 142 of external barrier 130 (as best shown in FIG. 2B) while drinking from first sipping orifice 120 or second sipping orifice 125. This arrangement preferably assists preventing the user from physical discomfort while drinking from first sipping orifice 120 or second sipping orifice 125.

External barrier 130 preferably comprises at least one annular side wall 145 (as best shown in FIG. 1A and FIG. 2B) which preferably accommodates the bottom lip of the consumer while drinking from either first sipping orifice 120 or second sipping orifice 125. External barrier 130 further preferably comprises at least one annular recess 148 (as best shown in FIG. 1A and FIG. 2B) which preferably accommodates the upper lip of the consumer while drinking from either first sipping orifice 120 or second sipping orifice 125. External barrier 130 further comprises at least one D-shaped recess 144 (as best shown in FIG. 1A and FIG. 2B) which preferably accommodate the nose of the consumer while drinking from either first sipping orifice 120 or second sipping orifice 125.

Furthermore, external barrier 130 preferably comprises at least one ventilation hole 149, as shown in FIG. 2A and FIG. 2B. Ventilation hole 149 preferably is structured and arranged to preferably provide ventilation to at least one portion of consumable liquid 400 preferably passing through in internal barrier 150 (see details below). Upon reading this specification, those with ordinary skill in the art will now appreciate that, under appropriate circumstances, considering such issues as design preference, user preferences, manufacturing preferences, cost, structural requirements, available materials, etc., other ventilation arrangements such as, for example, multiple ventilation holes, larger ventilation apertures, etc., may suffice.

Figure 3:
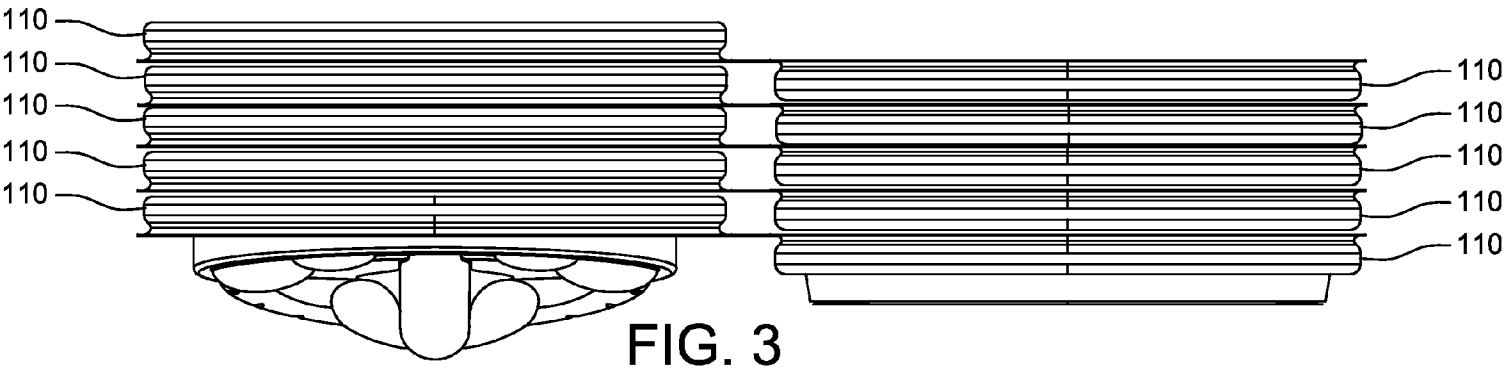
FIG. 3 shows a side view, illustrating the beverage lid in a stacked arrangement, according to the preferred embodiment of FIG. 1A.

FIG. 3 shows a side view, illustrating beverage lid 110 in a stacked arrangement, according to the preferred embodiment of FIG. 1A. When internal barrier 150 and external barrier 130 are disconnected, beverage lid 110 preferably may be stacked for storage purposes, as shown in FIG. 3. This feature of beverage lid 110 preferably offers advantages to manufacturers and retailers for shipping and/or storing large quantities of beverage lid 110.

Internal barrier 150 (at least embodying herein at least one first barrier structured and arranged to provide at least one first barrier between the at least one fluid contained in the at least one beverage container and the external environment)

preferably comprises the primary components involved in the thermal exchange capabilities of the present invention (see FIG. 1B). Internal barrier 150 preferably comprises fluid-transport pathway 164, as shown. Fluid-transport pathway 164 preferably is involved in transporting at least one portion of consumable liquid 400 within beverage lid 110 from beverage container 300 to the beverage consumer. Fluid-transport pathway 164 preferably functions to collect and preferably hold, at least temporarily, at least one portion of consumable liquid 400 passing through beverage lid 110 (see details below).

Fluid-transport pathway 164 preferably comprises at least one loading aperture 200, as shown in FIG. 2B. Loading aperture 200 (at least herein embodying wherein such at least one cover comprises at least one fluid-transfer passage structured and arranged to assist transfer passage of the at least one portion of the at least one fluid from the at least one beverage container to such at least one fluid-transport pathway) preferably is structured and arranged to preferably deliver at least one portion of consumable liquid 400 from beverage container 300 to receiving reservoir 165 (see details below). This step preferably initiates the thermal exchange process performed by beverage lid 110 (see details below).

Fluid-transport pathway 164 preferably comprises at least one receiving reservoir 165 (at least herein embodying wherein such at least one plurality of reservoirs comprises at least one receiving reservoir structured and arranged to receive the at least one portion of the at least one fluid from the at least one beverage container transferred from the at least one beverage container through such at least one transfer passage), preferably at least two receiving reservoirs 165, preferably symmetrically disposed, as shown in FIG. 2A. This arrangement at least herein embodies wherein such at least one collecting reservoir comprises at least first receiving reservoir and at least one second receiving reservoir symmetrically disposed around the periphery of such at least one cover.

Receiving reservoirs 165 preferably receive and collect at least one portion of consumable liquid 400 delivered from beverage container 300 through loading aperture 200 (see details below).

Fluid-transport pathway 164 further preferably comprises at least one transfer reservoir 170 (at least herein embodying wherein such at least one plurality of reservoirs comprises in fluid communication with such at least one receiving reservoir, at least one transfer reservoir structured and arranged to receive the at least one portion of the at least one fluid from such at least one collecting reservoir), preferably at least two transfer reservoirs 170, preferably symmetrically disposed around the periphery of internal barrier 150, as shown in FIG. 2A. This arrangement at least herein embodies wherein such at least one transfer reservoir comprises at least one first transfer reservoir and at least one second transfer reservoir symmetrically disposed around the periphery of such at least one cover.

Transfer reservoirs 170 preferably collect at least one portion of consumable liquid 400 from receiving reservoirs 165 (see details below).

Fluid-transport pathway 164 further preferably comprises at least one central storage reservoir 175 (at least herein embodying wherein such at least one plurality of reservoirs comprises in fluid communication with such at least one transfer reservoir, at least one storage reservoir structured and arranged to store such at least one portion of the at least one fluid received from such at least one transfer reservoir) which preferably stores, at least temporarily, at least one portion of consumable liquid 400 preferably before delivery to first sipping orifice 120 (see details below). Central storage reservoir 175 preferably comprises a concave basin having a semi-ellipsoidal geometry. Upon reading this specification, those with ordinary skill in the art will now appreciate that, under appropriate circumstances, considering such issues as design preference, user preferences, manufacturing preferences, cost, structural requirements, available materials, etc., other reservoir arrangements such as, for example, more reservoirs, fewer reservoirs, non-symmetrical arrangement of reservoirs, etc., may suffice.

According to the preferred embodiment illustrated in FIG. 1A, beverage lid 110 preferably comprises five reservoirs, each configured to at least temporarily hold at least one portion of consumable liquid 400 flowing through fluid-transport pathway 164, as shown. This arrangement at least herein embodies wherein such at least one temperature biaser comprises within such at least one fluid-transport pathway, at least one plurality of reservoirs structured and arranged to at least temporarily hold the at least one portion of the at least one fluid, transferred from the at least one beverage container to such at least one cover; and this arrangement at least herein embodies wherein such at least one plurality of reservoirs comprises at least three reservoirs.

Fluid-transport pathway 164 preferably comprises at least one fluid mixer 181 (at least embodying herein at least one mixer structured and arranged to mix the at least one portion of the at least one fluid flowing through such at least one fluid-transport pathway). Fluid mixer 181 preferably functions to mix the consumable liquid 400 as the beverage flows through fluid-transport pathway 164. Fluid mixer 181 preferably promotes thermal exchange between consumable liquid 400 and the external environment (this arrangement at least herein embodying wherein such at least one mixer promotes thermal exchange between the at least one portion of the at least one fluid flowing through such at least one mixing flow channel and the external environment).

In one preferred arrangement of the present system, fluid mixer 181 is preferably incorporated within at least one mixing flow channel 180 of fluid-transport pathway 164, as shown. More preferably, fluid-transport pathway 164 comprises at least two mixing flow channels 180, preferably symmetrically disposed around the periphery of internal barrier 150, as shown in FIG. 2A (this arrangement at least herein embodies wherein such at least one mixing flow channel comprises at least one first mixing flow channel and at least one second mixing flow channel symmetrically disposed around the periphery of such at least one cover).

Mixing flow channels 180 (at least herein embodying at least one plurality of flow channels structured and arranged to channel the at least one portion of the at least one fluid to flow between such at least one plurality of reservoirs; and at least herein embodying wherein such at least one plurality of flow channels comprises at least one mixing flow channel structured and arranged to comprise such at least one mixer) preferably are structured and arranged to preferably channel at least one portion of consumable liquid 400 flowing between transfer reservoirs 170 and central storage reservoir 175 (see details below). This arrangement at least herein embodies wherein such at least one mixing flow channel is disposed between such at least one transfer reservoir and such at least one storage reservoir.

In one preferred embodiment of the present invention, each mixing flow channel 180 preferably comprises a recessed arcuate channel having a semi-circular base section, as shown. Each mixing flow channel 180 preferably slopes toward central storage reservoir 175 and preferably comprises a generally uniform transverse channel width of about two tenths of an inch. Upon reading this specification, those with ordinary skill in the art will now appreciate that, under appropriate circumstances, considering such issues as design preference, user preferences, manufacturing preferences, cost, structural requirements, available materials, etc., other mixing flow channel arrangements such as, for example, wider, thinner, non-symmetrical arrangement, etc., may suffice.

Mixing flow channels 180 preferably comprise at least one mixing contour 182, preferably at least three mixing contours 182, as shown in FIG. 2A. Mixing contours 182 preferably comprise surface protrusions which preferably mix and preferably break the flow of at least one portion of consumable liquid 400 flowing through mixing flow channel 180 (see below) (this arrangement at least herein embodies wherein such at least one mixer comprises at least three surface protrusions projecting outwardly into such at least one fluid-transport pathway). This process preferably participates in the thermal exchange function of beverage lid 110 (see further details below).

Fluid-transport pathway 164 preferably comprises at least one central flow channel 185 (at least herein embodying wherein such at least one plurality of flow channels comprises at least one central flow channel structured and arranged to provide at least one route to assist the at least one portion of the at least one fluid to flow from such at least one storage reservoir to such at least one first sipping orifice), which is preferably centrally located, as shown in FIG. 2A. Central flow channel 185 preferably assist in delivering at least one portion of consumable liquid 400 from central storage reservoir 175 to first sipping orifice 120 when beverage container 300 is tipped toward first sipping orifice 120 into the mouth of the consumer (see further details below) (this arrangement at least herein embodying wherein flow of the at least one portion of the at least one fluid through such at least one central flow channel to such at least one first sipping is assisted by tipping such at least one beverage container, covered by such at least one cover, from the generally upright position to the at least one non-upright position biased towards such at least one sipping orifice).

As shown in FIG. 2A, internal barrier 150 further preferably comprises at least one guiding panel 198, preferably at least two guiding panels 198, which preferably flank either side of central flow channel 185, as shown. Guiding panels 198 preferably assist guiding the flow of consumable liquid to first sipping orifice 120, and also preferably assist preventing backflow of consumable liquid 400 into receiving reservoir 165.

Internal barrier 150 further preferably comprises at least one secondary drinking hole 190 which preferably assists delivering consumable liquid 400 from beverage container 300 to second sipping orifice 125 (see below). In one preferred embodiment of the present invention, secondary drinking hole 190 preferably has a longest width of about one and three quarters of an inch. Upon reading this specification, those with ordinary skill in the art will now appreciate that, under appropriate circumstances, considering such issues as design preference, user preferences, manufacturing preferences, cost, structural requirements, available materials, etc., other size arrangements such as, for example, wider, thinner, etc., may suffice. The passage of at least one portion of consumable liquid 400 through fluid-transport pathway 164 of internal barrier 150 preferably provides the process by which beverage lid 110 preferably promotes thermal exchange between consumable liquid 400 and the surrounding environment. The principle preferred mechanism of this process operates by significantly enhancing the surface area of consumable liquid 400 which is exposed to the surrounding environment, thus preferably promoting thermal exchange between consumable liquid 400 and the surrounding environment. As a result of the enhanced exposure of consumable liquid 400 to the surrounding environment, beverage lid 110 preferably promotes a shift in the temperature of consumable liquid 400 towards room temperature (at least embodying herein at least one surface-area maximizer structured and arranged to maximize the surface area of the at least one portion of the at least one fluid transferred by such at least one fluid-transport pathway, wherein such at least one surface area maximizer promotes thermal exchange between the at least one portion of the at least one fluid with the external environment). The thermal exchange process of beverage lid 110 preferably is initiated upon tipping beverage container 300, with attached beverage lid 110, towards first sipping orifice 120 (see below).

FIG. 4 through FIG. 8 illustrate the sequential steps involved in supplying at least one sip 402 of consumable liquid 400, with temperature adjusted towards room temperature, to the consumer through first sipping orifice 120.

Figure 4A:
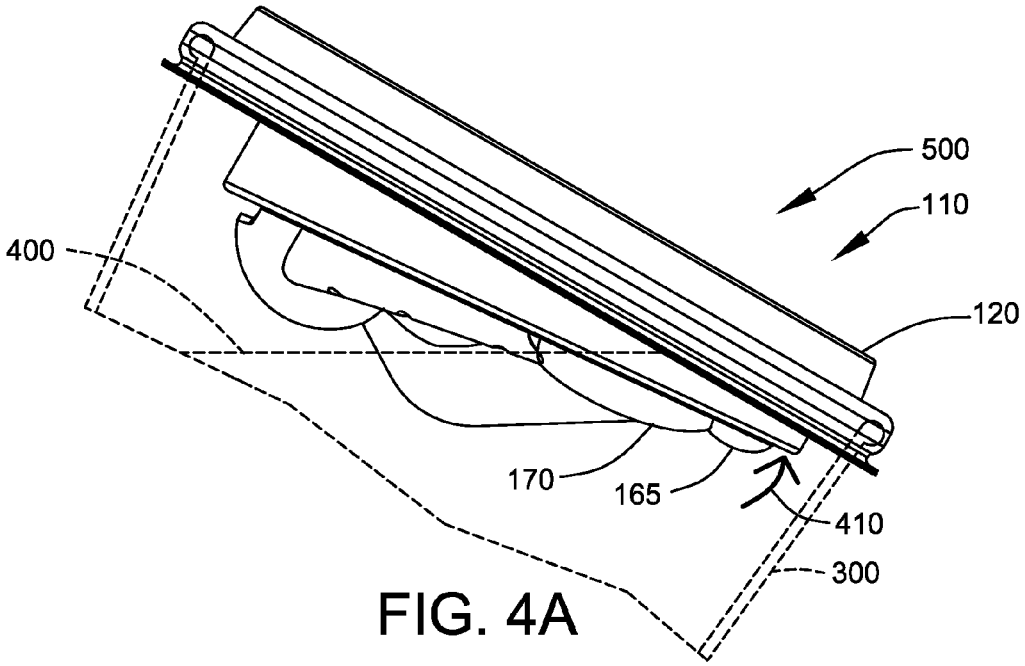
FIG. 4A shows a side view, illustrating the loading step initiated by tipping the beverage container toward the first sipping orifice, according to the preferred embodiment of FIG. 1A.
Figure 4B:
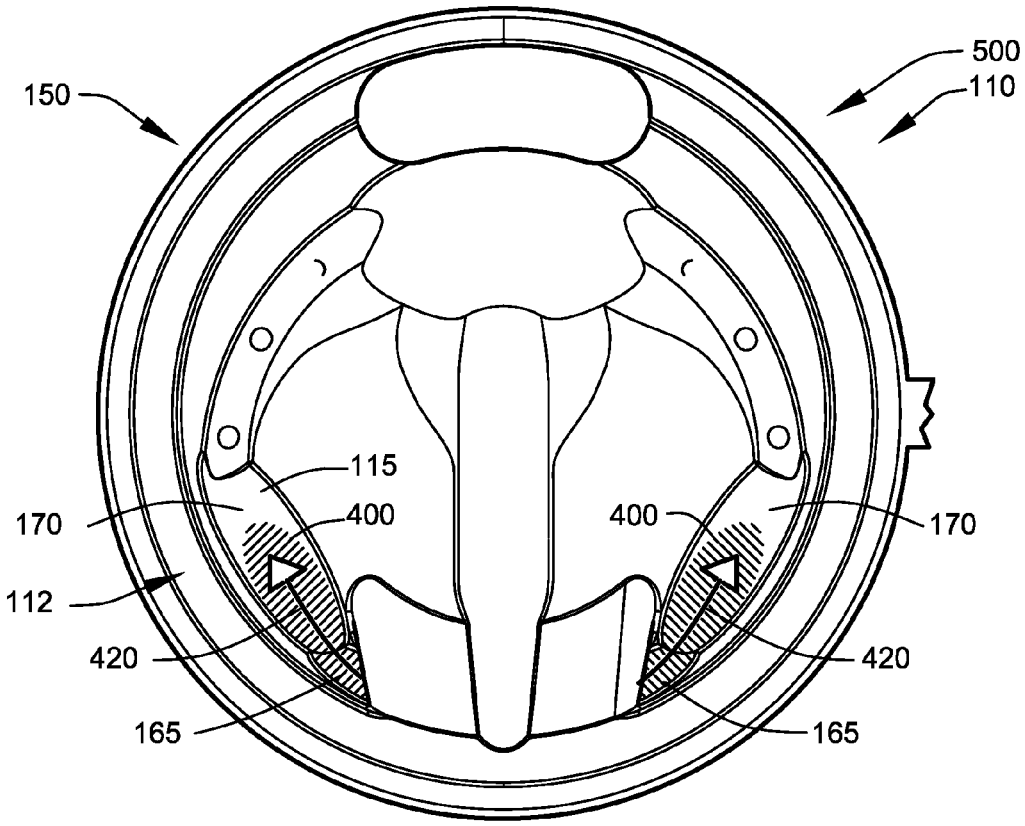
FIG. 4B shows a top view, illustrating the flow path followed by at least one portion of consumable liquid during the loading step, according to the preferred embodiment of FIG. 4A.

FIG. 4A shows a side view, illustrating loading step 500 initiated by tipping beverage container 300 toward first sipping orifice 120, according to the preferred embodiment of FIG. 1A. FIG. 4B shows a top view, illustrating the flow path 420 followed by at least one portion of consumable liquid 400 during loading step 500, according to the preferred embodiment of FIG. 4A.

To initiate the thermal exchange process of beverage lid 110, the consumer preferably tips beverage container 300 towards first sipping orifice 120, as shown in FIG. 4A. The user preferably tips beverage container 300 from a generally upright position to a non-upright position that is preferably biased towards first sipping orifice 120, as shown. During such tipping maneuver, beverage lid 110 rotates from a generally horizontal orientation (relative to upper surface 141 of annular raised portion 140) to a non-horizontal orientation, as shown. This step preferably initiates the flow of consumable liquid 400 through loading aperture 200 according to loading path 410 (see FIG. 4A and FIG. 5).

Figure 5:
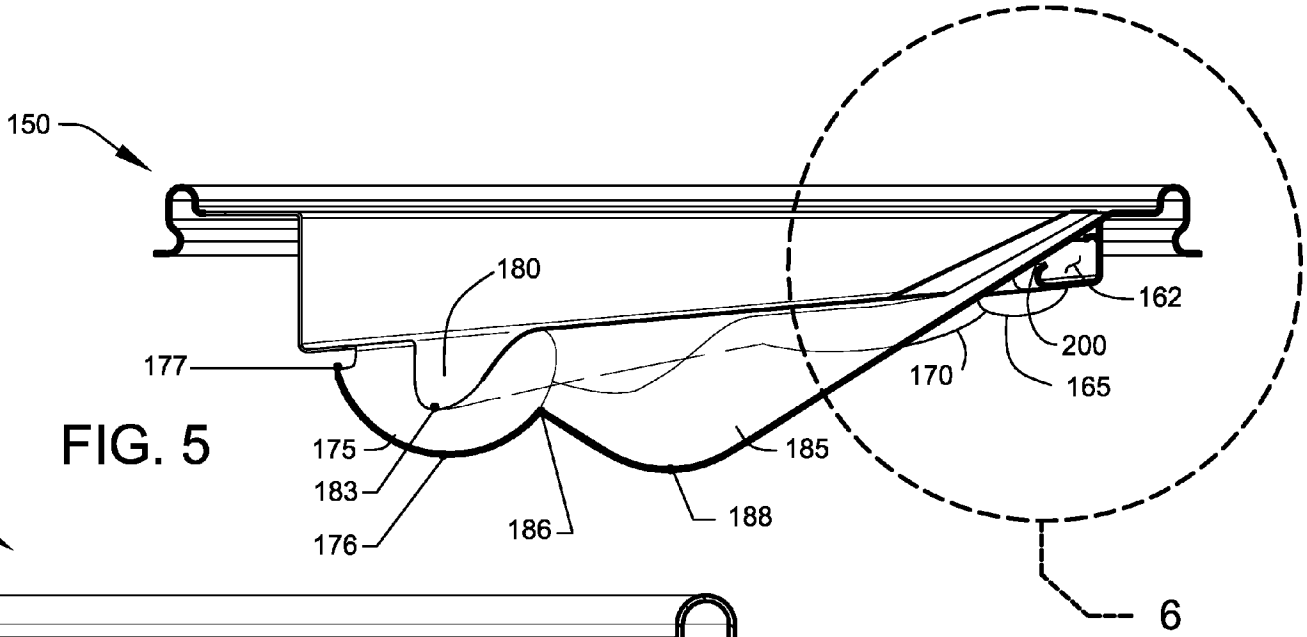
FIG. 5 shows a sectional view through the section 5-5 of FIG. 2A, illustrating the loading aperture of the beverage lid, according to the preferred embodiment of FIG. 1A.
Figure 6:
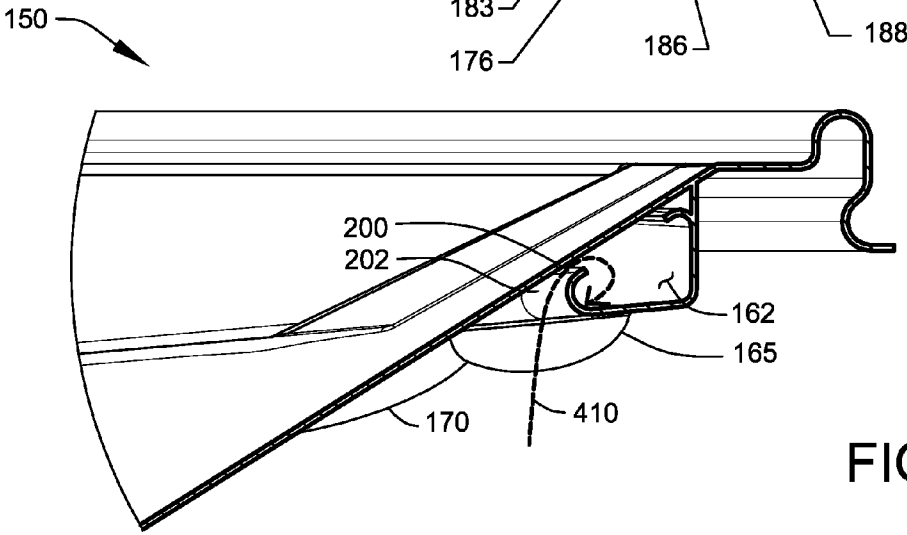
FIG. 6 shows an enlarged view of detail 6 of FIG. 5, illustrating the loading aperture of the beverage lid, according to the preferred embodiment of FIG. 1A.

FIG. 5 shows a sectional view through the section 5-5 of FIG. 2A, illustrating loading aperture 200 of beverage lid 110, according to the preferred embodiment of FIG. 1A. FIG. 6 shows an enlarged view of detail 6 of FIG. 5, illustrating loading aperture 200 of beverage lid 110, according to the preferred embodiment of FIG. 1A. FIG. 6 illustrates loading path 410 preferably followed by consumable liquid 400, as beverage container 300 is tipped towards first sipping orifice 120 (see FIG. 4A). After passing through loading aperture 200, at least one portion of consumable liquid 400 preferably is initially caught in receiving channel 162, as shown. As best shown in FIG. 6, loading aperture 200 preferably comprises lip portion 202 which preferably is structured and arranged to preferably prevent backflow of consumable liquid 400 from receiving channel 162 into beverage container 300. After catching of consumable liquid 400 by receiving channel 162, at least one portion of consumable liquid 400 preferably is passed to receiving reservoir 165, according to flow path 420 (also see FIG. 4B). Consumable liquid 400 subsequently flows into transfer reservoir 170, according to flow path 420 (see FIG. 4B), preferably while beverage container 300 is tipped as shown in FIG. 4A. Flow is preferably initiated in both the clockwise and counterclockwise directions around the periphery of internal barrier 150, according to flow path 420, as shown in FIG. 4B. Receiving reservoir 165 and transfer reservoir 170 each generally comprise concave depressions having a preferred semi-ellipsoidal geometry, as shown.

The shaded regions of FIG. 4B diagrammatically illustrate representative initial volumes of consumable liquid 400 transferred to receiving reservoir 165 and transfer reservoir 170 during the initial loading step 500.

Figure 7A:
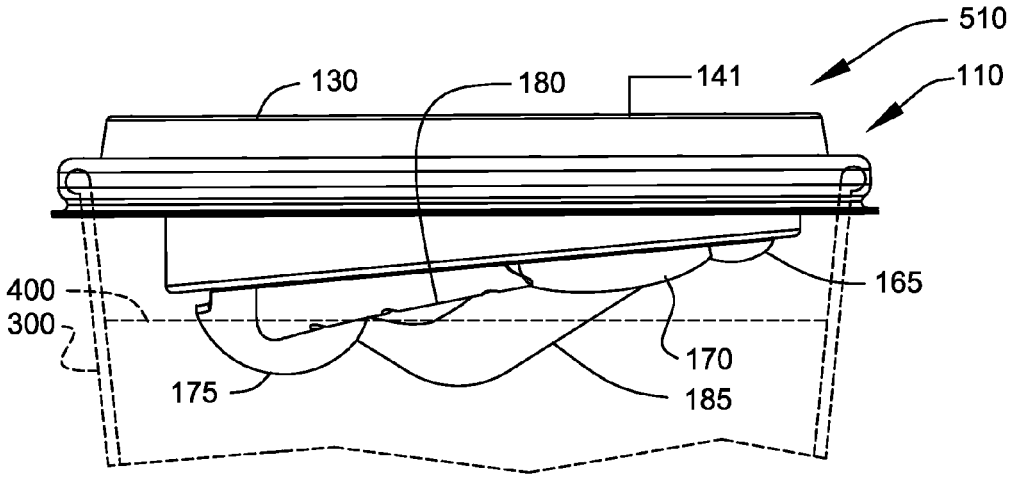
FIG. 7A shows a side view, illustrating the mixing step initiated by tipping the beverage container back to a horizontal position after the loading step, according to the preferred embodiment of FIG. 4A.
Figure 7B:
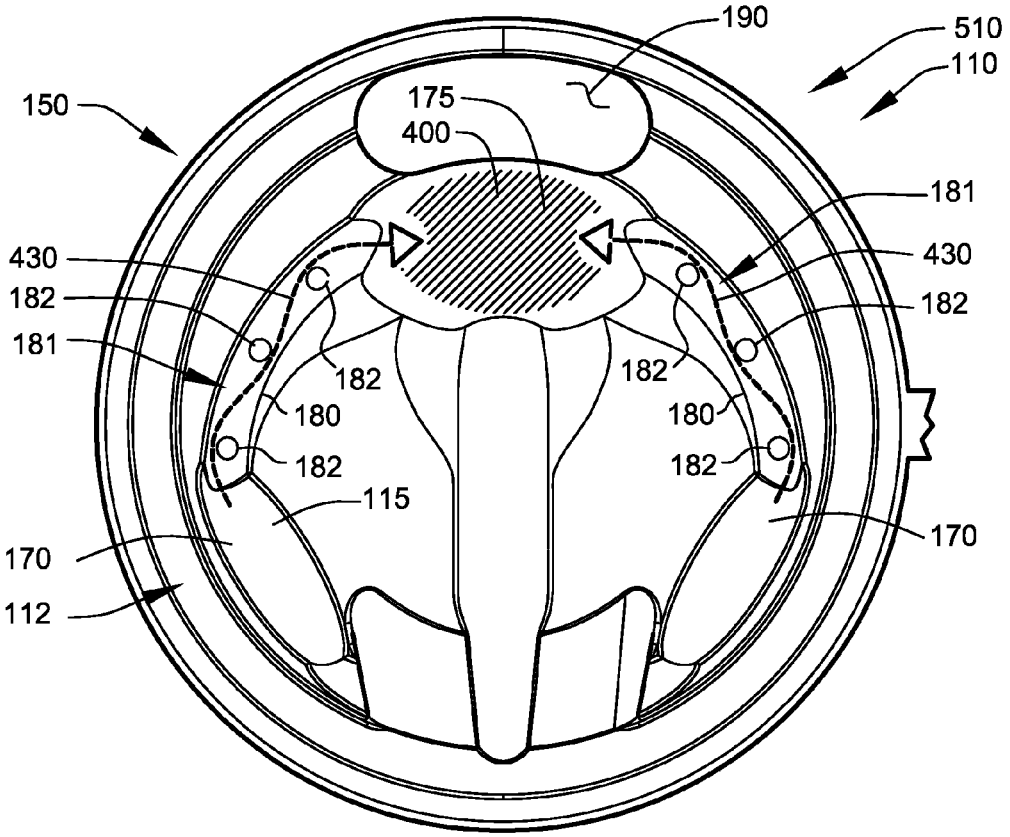
FIG. 7B shows a top view, illustrating the flow path followed by at least one portion of consumable liquid during the mixing step, according to the preferred embodiment of FIG. 7A.

FIG. 7A shows a side view, illustrating mixing step 510 initiated by tipping beverage container 300 back to a generally upright orientation after loading step 500, according to the preferred embodiment of FIG. 4A. FIG. 7B shows a top view, illustrating flow path 430 followed by at least one portion of consumable liquid 400 during mixing step 510, according to the preferred embodiment of FIG. 7A. As the consumer tips beverage container 300 back to rotate beverage lid 110 toward a horizontal position (see FIG. 4A and FIG. 4B), the volume of consumable liquid 400 introduced in loading step 500 preferably flows from transfer reservoirs 170 to mixing flow channels 180 and preferably collects in central storage reservoir 175, as shown by flow path 430 (see FIG. 7B). Flow path 430 preferably occurs in both the clockwise and counterclockwise directions around the periphery of internal barrier 150, as shown. Transfer reservoirs 170, mixing flow channels 180, and central storage reservoir 175 preferably are sloped with respect to one another such that consumable liquid 400 preferably flows by gravity assistance from each transfer reservoir 170 to each mixing flow channel 180 into central storage reservoir 175 by flow path 430, as shown, preferably while beverage lid 110 is held in the horizontal position by the consumer (this arrangement at least herein embodying wherein such at least one fluid-transport pathway comprises at least one flow assistor structured and arranged to assist flow of the at least one portion of the at least one fluid, transferred from the at least one beverage container to such at least one cover, through such at least one plurality of reservoirs and through such at least one plurality of flow channels).

While passing through mixing flow channels 180, the flow of consumable liquid 400 is preferably perturbed by mixing contours 182, as shown by flow path 430 (see FIG. 7B). Mixing contours 182 preferably present at least three surface protrusions in mixing flow channels 180 which preferably aid in breaking the flow and mixing consumable liquid 400 as it passes through mixing flow channel 180. This step preferably further increases the surface area of consumable liquid 400 that is exposed to the external environment, and also functions to slow the rate of flow, thus preferably increasing the duration in which consumable liquid 400 remains in such a state of enhanced surface interaction. These preferred mechanisms further assist with shifting consumable liquid 400 towards temperature equilibrium with the ambient room temperature. Upon reading this specification, those with ordinary skill in the art will now appreciate that, under appropriate circumstances, considering such issues as design preference, user preferences, manufacturing preferences, cost, structural requirements, available materials, etc., other mixing arrangements such as, for example, surface bumps, surface dips, other non-linear flow path arrangements, etc., may suffice.

As consumable liquid 400 collects in central storage reservoir 175, any volume of consumable liquid 400 in excess of the volume capacity of receiving reservoir 165 preferably spills over through secondary drinking hole 190 back into beverage container 300 to preferably join the bulk of consumable liquid 400. The volume capacity of central storage reservoir 175 preferably is about one ounce (this arrangement at least herein embodying wherein such at least one storage reservoir comprises at least one volume capacity limiter structured and arranged to limit the volume of the at least one portion of the at least one fluid stored by such at least one storage reservoir). This arrangement preferably limits the sipping volume delivered to the consumer through first sipping orifice 120 to about one ounce (this arrangement at least herein embodying wherein such at least one volume capacity limiter limits the volume of the at least one sip of the at least one fluid with temperature disposed towards room temperature provided to the at least one consumer by such at least one cover). Upon reading this specification, those with ordinary skill in the art will now appreciate that, under appropriate circumstances, considering such issues as design preference, user preferences, manufacturing preferences, cost, structural requirements, available materials, etc., other volume capacities such as, for example, larger volumes, smaller volumes, etc., may suffice.

The steps of passing at least one portion of consumable liquid 400 through receiving reservoirs 165, transfer reservoirs 170, and mixing flow channels 180, followed by collection in central storage reservoir 175 (see FIG. 4B and FIG. 5B) during loading step 500 and mixing step 510, preferably provides the primary thermal exchange process performed by beverage lid 110. These steps preferably assist optimizing the amount of surface area of consumable liquid 400 which is exposed to the surrounding environment, thereby preferably assisting shifting the temperature of consumable liquid 400 towards room temperature.

Figure 8A:
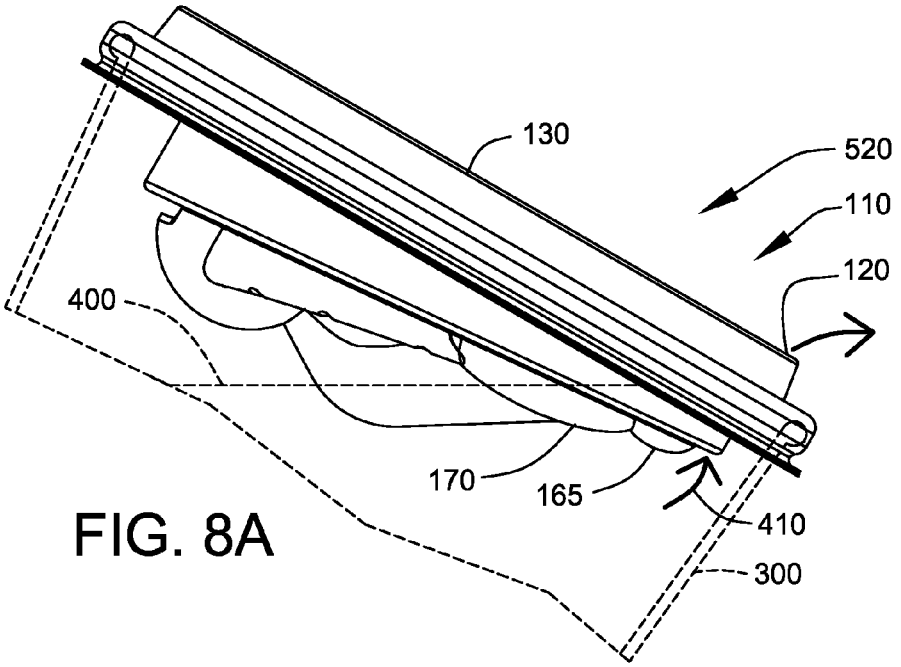
FIG. 8A shows a side view, illustrating the delivery step and re-loading step initiated by tipping the beverage container toward the first sipping orifice after the mixing step, according to the preferred embodiment of FIG. 7A.
Figure 8B:
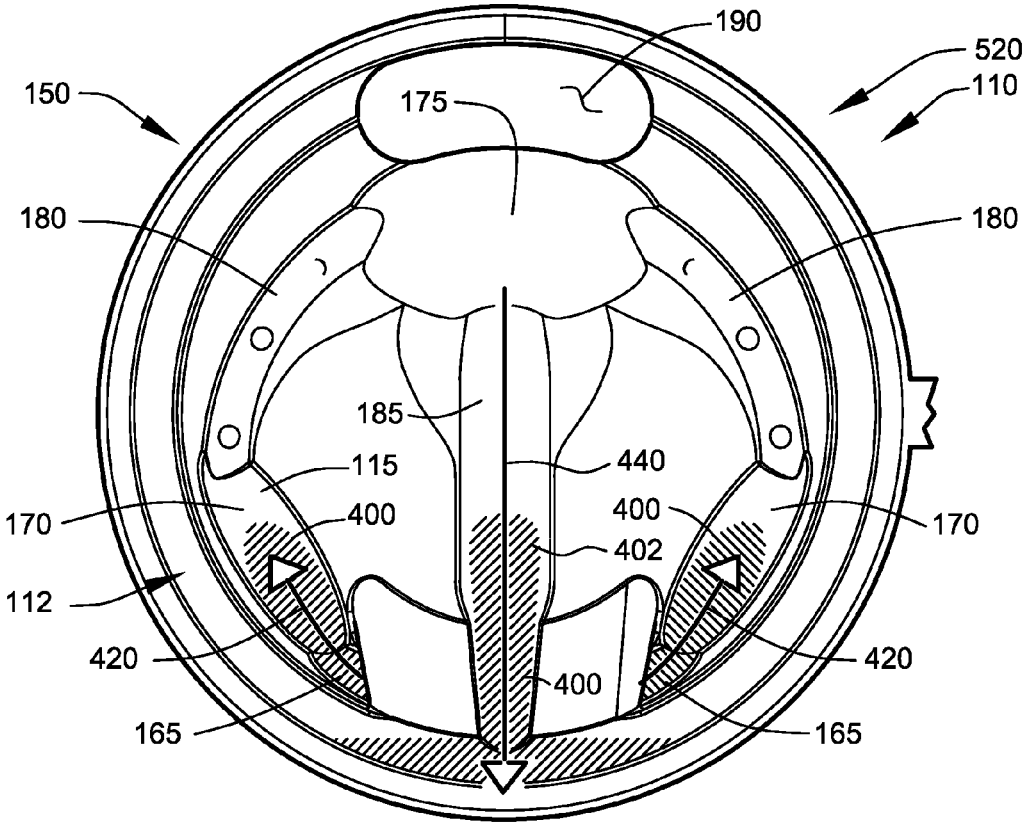
FIG. 8B shows a top view, illustrating the flow path followed by at least one sip of consumable liquid during the delivery step and the flow path followed by at least one additional portion of consumable liquid during the re-loading step, according to the preferred embodiment of FIG. 8A.

FIG. 8A shows a side view, illustrating delivery step 520 and re-loading step 530 initiated by tipping beverage container 300 toward first sipping orifice 120 after mixing step 510, according to the preferred embodiment of FIG. 7A. FIG. 8B shows a top view, illustrating flow path 440 followed by at least one sip 402 of consumable liquid during delivery step 520 and flow path 420 followed by at least one additional portion of consumable liquid during re-loading step 530, according to the preferred embodiment of FIG. 8A. As the consumer tips beverage container 300 towards first sipping orifice 120 for a second time after mixing step 510 (see FIG. 8A and FIG. 8B), at least one sip 402 of consumable liquid 400 preferably flows, according to flow path 440, from central storage reservoir 175 to central flow channel 185, as shown. Consumable liquid 400 preferably then flows through central flow channel 185 and out through first sipping orifice 120, as shown by flow path 440, preferably delivering at least one sip 402 of consumable liquid 400 to the mouth of the consumer. Sip 402 preferably has a volume of about one ounce due to the limited volume capacity of central storage reservoir 175. Upon reading this specification, those with ordinary skill in the art will now appreciate that, under appropriate circumstances, considering such issues as design preference, user preferences, manufacturing preferences, cost, structural requirements, available materials, etc., other sipping volumes such as, for example, larger volumes, smaller volumes, etc., may suffice.

The passage of sip 402 from central storage reservoir 175 through central flow channel 185 preferably further assists exposing consumable liquid 400 to the surrounding environment, and preferably further assists shifting the temperature of consumable liquid 400 towards room temperature.

Sip 402 preferably has a temperature shifted closer to room temperature than the bulk of consumable liquid 400 contained in beverage container 300, preferably due to the thermal exchange processes and mixing steps preferably occurring during the passage of consumable liquid 400 through receiving reservoirs 165, transfer reservoirs 170, mixing flow channels 180, and central flow channel 185, as shown in FIG. 4 through FIG. 8. The steps illustrated in FIG. 4 through FIG. 8 preferably assist minimizing any thermal discomfort the consumer may experience due to drinking a fluid which is too hot or too cold.

FIG. 8B further illustrates re-loading step 530 of beverage lid 110 with at least one additional portion of consumable liquid 400 which occurs contemporaneously with delivery step 520. As beverage container 300 is tipped toward first sipping orifice 120 for a second time (see FIG. 8A) for delivery to the mouth of the consumer during delivery step 520, at least one additional portion of consumable liquid 400 preferably is re-loaded into beverage lid 110 according to loading path 410 during re-loading step 530 (see FIG. 6). Once consumable liquid 400 is collected in receiving reservoirs 165 during re-loading step 530, the at least one additional portion of consumable liquid 400 preferably flows from receiving reservoirs 165 into transfer reservoirs 170 according to flow path 420, as shown in FIG. 8B. The at least one additional portion of consumable liquid 400 loaded into beverage lid 110 during re-loading step 530 preferably then undergoes mixing step 510, preferably initiated by tipping beverage container 300 back to an upright position (see FIG. 7A and FIG. 7B). Mixing step 510 is then preferably followed by delivery step 520, along with another re-loading step 530, preferably initiated by tipping beverage container 300 toward first sipping orifice 120, as shown in FIGS. 8A and 8B). This process will preferably deliver an additional sip 402, with temperature preferably adjusted towards room temperature, to the consumer through first sipping orifice 120. Accordingly, the consumer preferably is only required to perform loading step 500 one time, preferably with an initial tip forward of beverage container 300 (as shown in FIG. 4A and FIG. 4B). With each additional tip forward of beverage container 300 toward first sipping orifice 120, beverage lid 110 preferably will automatically re-load itself by re-loading step 530 (at least herein embodying wherein such at least one cover further comprises at least one self-replenisher structured and arranged to self-replenish such at least one fluid-transport pathway with at least one additional portion of the at least one fluid from the at least one beverage container while providing to the at least one consumer the at least one sip of the at least one fluid with temperature disposed towards room temperature), as shown in FIG. 8A and FIG. 8B. This arrangement illustrates the self-replenishing feature of beverage lid 110, as shown in FIG. 8B.

As shown in FIG. 4A through FIG. 8B, the flow of consumable liquid 400 through fluid-transport pathway 164 of beverage lid 110 preferably occurs in both the clockwise and counterclockwise directions around the periphery of internal barrier 150 before delivery through central flow channel 185 to first sipping orifice 120. Upon reading this specification, those with ordinary skill in the art will now appreciate that, under appropriate circumstances, considering such issues as design preference, user preferences, manufacturing preferences, cost, structural requirements, available materials, etc., other directional flow arrangements such as, for example, only clockwise, only counterclockwise, linear flow arrangements, linear back and forth flow arrangement, other non-linear flow arrangements, etc., may suffice.

After sufficient time has passed, and as the bulk of consumable liquid 400 contained in beverage container 300 cools (or warms) to room temperature, the consumer may preferably choose to drink directly from beverage container 300 through second sipping orifice 125. By choosing to drink from second sipping orifice 125, the consumer preferably chooses to bypass the thermal exchange steps illustrated in FIG. 4A through FIG. 8B. In this case, the consumer preferably tips beverage container 300 towards second sipping orifice 125, in order to drink from second sipping orifice 125. At least one portion of consumable liquid preferably is passed through secondary drinking hole 190 and preferably is delivered to the mouth of the consumer through second sipping orifice 125.

Figure 9:
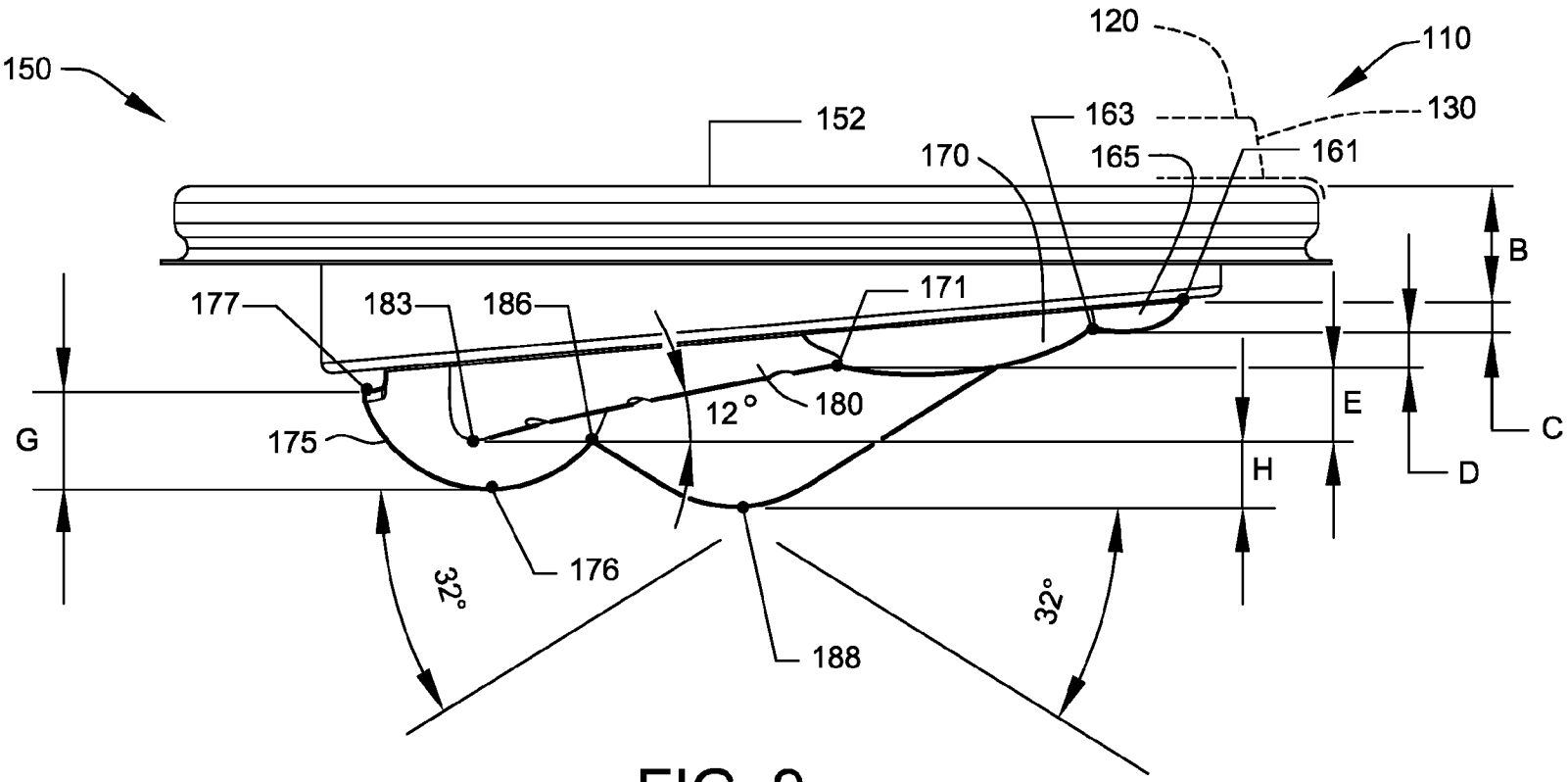
FIG. 9 shows a side view, illustrating the internal barrier of the beverage lid, according to the preferred embodiment of FIG. 1A.

FIG. 9 shows a side view, illustrating internal barrier 150 of beverage lid 110, according to the preferred embodiment of FIG. 1A. FIG. 9 illustrates the elevation drop between the reservoirs and flow channels of fluid-transport pathway 164, according to the preferred embodiment of FIG. 1A. As shown in FIG. 9, receiving reservoir 165 preferably comprises entry point 161 and exit point 163 which preferably represent the points of entry and exit, respectively, preferably passed by at least one portion of consumable liquid 400 flowing through receiving reservoir 165. From top surface 152 of internal barrier 150 to entry point 161 of receiving reservoir 165, the elevation drop preferably is about one third of an inch, as shown by dimension B. From entry point 161 to exit point 163, the elevation drop is about one sixteenth of an inch, as shown by dimension C. From exit point 163 of receiving reservoir 165 (exit point 163 also represents the entry point of transfer reservoir 170) to exit point 171 of transfer reservoir 170, the elevation drop preferably is about one eighth of an inch, as shown by dimension D. As such, gravity will preferably assist movement of consumable liquid 400 through receiving reservoir 165 to transfer reservoir 170 when beverage lid 110 is held in a horizontal orientation, as shown in FIG. 9. Upon reading this specification, those with ordinary skill in the art will now appreciate that, under appropriate circumstances, considering such issues as design preference, user preferences, manufacturing preferences, cost, structural requirements, available materials, etc., other elevation drop arrangements such as, steeper elevation drops, more shallow elevation drops, etc., may suffice.

From exit point 171 of transfer reservoir 170 (exit point 171 also represents the entry point of mixing flow channel 180) to exit point 183 of mixing flow channel 180, the elevation drop preferably is about one quarter of an inch, as shown by dimension E in FIG. 9. In addition, mixing flow channel 180 preferably falls by about a 12° angle relative to horizontal, as shown (this arrangement at least herein embodying wherein such at least one mixing flow channel comprises at least one slope structured and arranged to assist flow of the at least one portion of the at least one fluid between such at least one transfer reservoir and such at least one storage reservoir; and this arrangement at least herein embodying wherein such at least one slope of such at least one mixing flow channel comprises and angle of about a 12° relative to horizontal). From exit point 183 of mixing flow channel 180 (exit point 183 also represents the entry point to central storage reservoir 175) to bottom surface 176 of central storage reservoir 175, the elevation drop preferably is about one seventh of an inch, as shown by dimension F. Accordingly, gravity will preferably assist movement of consumable liquid 400 from receiving reservoir 165 to transfer reservoir 170 through mixing flow channel 180 for collection in central storage reservoir 175, as shown, when beverage lid 110 is held in a horizontal orientation (this arrangement at least herein embodying wherein such at least one receiving reservoir, such least one transfer reservoir, and such at least one mixing flow channel are each geometrically configured to provide gravity-assisted sequential flow of the at least one portion of the at least one fluid from such at least one receiving reservoir to such at least one transfer reservoir to such at least one mixing flow channel to such at least one storage reservoir when such at least one cover is placed in about a horizontal position). Upon reading this specification, those with ordinary skill in the art will now appreciate that, under appropriate circumstances, considering such issues as design preference, user preferences, manufacturing preferences, cost, structural requirements, available materials, etc., other elevation drop arrangements such as, steeper elevation drops, more shallow elevation drops, etc., may suffice.

As shown in FIG. 9, from bottom surface 176 of central storage reservoir 175 to overflow edge 177 of central storage reservoir 175, the elevation rise preferably is about one-half inch, as shown by dimension G. Consumable liquid 400 may fill from bottom surface 176 of central storage reservoir 175 until reaching overflow edge 177, after which consumable liquid 400 preferably overflows past overflow edge 177 to preferably collect in beverage container 300.

From exit point 186 of central storage reservoir 175 (exit point 186 also represents the entry point to central flow channel 185) to bottom surface 188 of central flow channel 185, the elevation drop preferably is about one fifth of an inch, as shown by dimension H in FIG. 9. In addition, central flow channel 185 preferably falls by about a 32° angle relative to horizontal from exit point 186 of receiving reservoir 165 to bottom surface 188 of central flow channel 185, as shown in FIG. 9. This arrangement preferably promotes the flow of consumable liquid 400 from central storage reservoir 175 into central flow channel 185 after the volume of consumable liquid 400 in storage reservoir rises past the level of exit point 186. Upon reading this specification, those with ordinary skill in the art will now appreciate that, under appropriate circumstances, considering such issues as design preference, user preferences, manufacturing preferences, cost, structural requirements, available materials, etc., other elevation drop arrangements such as, steeper elevation drops, more shallow elevation drops, etc., may suffice.

Central flow channel preferably rises by about a 32° angle, relative to horizontal, from bottom surface 188 of central flow channel 185 toward first sipping orifice 120, as shown in FIG. 9.

Although applicant has described applicant's preferred embodiments of this invention, it will be understood that the broadest scope of this invention includes modifications such as diverse shapes, sizes, and materials. Such scope is limited only by the below claims as read in connection with the above specification. Further, many other advantages of applicant's invention will be apparent to those skilled in the art from the above descriptions and the below claims.

What is claimed is:

1. A system for assisting thermal exchange between a portion of fluid from a beverage container and the external environment so that said portion of the fluid may be consumed at a temperature disposed towards room temperature, said system comprising:

a) the beverage container with a basin featuring the fluid at a temperature that is not room temperature;

b) a cover that is configured to cover an opening of the basin of the beverage container, said cover defined by i. an internal barrier with a loading aperture and a secondary drinking hole, ii. an external barrier with a first sipping orifice and a second sipping orifice, iii. a fluid transport pathway between the loading aperture and the first sipping orifice, said fluid transport pathway defined by aa. a receiving reservoir that is in fluid communication with the loading aperture, bb. a transfer reservoir that is in fluid communication with a loading reservoir, cc. a first channel that is in fluid communication with the transfer reservoir;

dd. a central storage reservoir that is in fluid communication with the first channel, said central storage reservoir being defined on an overflow edge by the secondary drinking hole, wherein said overflow edge is lower in elevation than said loading aperture but higher in elevation than a bottom surface of the central storage reservoir so that fluid in excess of said portion received in said reservoir may spillover said edge through the secondary drinking hole back into the beverage container, and, ee. a second channel that is in fluid communication with the central storage reservoir and the first sipping orifice, iv. wherein the second sipping orifice is in fluid communication with the basin of the beverage container via the secondary drinking hole;

c) wherein the fluid may flow from through the second sipping orifice when the beverage container is tipped toward the second sipping orifice; and, d) wherein the portion of fluid may i. enter the cover via the loading aperture when the beverage container is tipped toward the first sipping orifice, ii. be retained by the receiving reservoir when the beverage container is tipped upright, iii. flow via gravity from the receiving reservoir to the central storage reservoir along the transfer reservoir and first channel, wherein heat is exchanged between the portion of fluid and the external environment while the portion of fluid moves along the transfer reservoir and channel, and iv. flow via gravity from the central storage reservoir to the first sipping orifice via the second channel whenever the beverage container is tipped toward the first sipping orifice, wherein the portion is more disposed towards room temperature than the fluid remaining in the basin.

2. The system according to claim 1 wherein said internal barrier further comprises at least one self-replenisher structured and arranged to self-replenish said at least one fluid-transport pathway.

3. The system according to claim 2 wherein said fluid transport pathway comprises:

a) a surface-area maximizer structured and arranged to maximize the surface area of the fluid transferred by said fluid-transport pathway;

b) wherein said surface area maximizer promotes thermal exchange between the fluid with the external environment.

4. The system according to claim 1 wherein said receiving reservoir comprises at least a first receiving reservoir and a second receiving reservoir symmetrically disposed around the periphery of said internal barrier.

5. The system according to claim 4 wherein said transfer reservoir comprises at least a first transfer reservoir and a second transfer reservoir symmetrically disposed around the periphery of said-internal barrier.

6. The system according to claim 1 wherein said first channel features at least one mixer defined by at least three surface protrusions projecting outwardly into said first channel.

7. A system for assisting thermal exchange between a portion of fluid from a beverage container and the external environment so that said portion of the fluid may be consumed at a temperature disposed towards room temperature, said system comprising:

a) the beverage container with a basin featuring the fluid at a temperature that is not room temperature;

b) a cover that is configured to cover an opening of the basin of the beverage container, said cover defined by
  i. an internal barrier with a loading aperture,
  ii. an external barrier with a first sipping orifice,
  iii. a fluid transport pathway between the loading aperture and the first sipping orifice, said fluid transport pathway defined by
    aa. a receiving reservoir with a first elevation drop between
      a. an entry point that is in fluid communication with the loading aperture, and
      b. an exit point that is in fluid communication with a transfer reservoir,
    bb. the transfer reservoir with a second elevation drop between
      a. an entry point defined by the exit point of the receiving reservoir, and
      b. an exit point that is in fluid communication with a first channel,
    cc. the first channel with a third elevation drop between
      a. an entry point that is defined by the exit point of the transfer reservoir, and
      b. an exit point that is in fluid communication with the a central storage reservoir;
    dd. the central storage reservoir with
      a. an entry point and exit point at the same elevation, wherein the entry point of the central storage reservoir is defined by the exit point of the first channel, and, the exit point of the central storage reservoir is in fluid communication with a second channel
    ee. the second channel that is in fluid communication with the central storage reservoir and the first sipping orifice, said second channel with an elevation drop between
      a. an entry point that is defined by the exit point of the central storage reservoir and,
      b. a bottom surface; and, c) wherein the portion of fluid may
  i. enter the cover via the loading aperture when the beverage container is tipped toward the first sipping orifice,
  ii. be retained by the receiving reservoir when the beverage container is tipped upright,
  iii. flow via gravity from the receiving reservoir to the central storage reservoir along the transfer reservoir and first channel, wherein heat is exchanged between the portion of fluid and the external environment while the portion of fluid moves along the transfer reservoir and channel, and,
  iv. flow via gravity from the central storage reservoir to the first sipping orifice via the second channel whenever the beverage container is tipped toward the first sipping orifice, wherein the portion is more disposed towards room temperature than the fluid remaining in the basin.

* * * * *